United States Patent [19]

Morrison

[11] 4,325,597

[45] Apr. 20, 1982

[54] FURNITURE SYSTEMS

[75] Inventor: Andrew I. Morrison, Setauket, N.Y.

[73] Assignee: Knoll International, Inc., New York, N.Y.

[21] Appl. No.: 134,437

[22] Filed: Mar. 27, 1980

[51] Int. Cl.[3] ..... A47B 43/00

[52] U.S. Cl. ..... 312/258; 312/263; 312/140.2; 229/44 R; 428/280

[58] Field of Search ..... 312/140.2, 258, 263, 312/330, 259; 428/212, 280, 537; 229/31 R, 44 R

[56] References Cited

U.S. PATENT DOCUMENTS

| | | | |
|---|---|---|---|
| 3,437,392 | 4/1969 | Helfinger | 312/258 |
| 3,835,795 | 9/1974 | Levenberg | 312/263 |
| 3,881,794 | 5/1975 | Henning | 312/259 |
| 3,933,401 | 1/1976 | Lampe et al. | 312/330 |
| 4,099,809 | 7/1978 | Leotta | 312/258 |
| 4,130,971 | 12/1978 | Herrig | 312/263 |
| 4,158,713 | 6/1979 | Degens | 428/280 |
| 4,162,190 | 7/1979 | Ashworth | 428/280 |

*Primary Examiner*—Victor N. Sakran
*Attorney, Agent, or Firm*—Michael Ebert

[57] ABSTRACT

A furniture system making it possible to efficiently and at low cost produce articles of furniture in a range of diverse forms and designs. The system is constituted by a basic, multi-section structural module that when erected acts to define the vertical side panels of a piece. The erected module is combinable with removable shelves, tops and other horizontal components adapted to bridge the side panels and rigidify the structure in a manner depending on the predetermined form and design of the piece. The multi-section module is created by two or more rectangular core panels in side-by-side relation to whose opposing faces are laminated fabric layers that serve to interconnect the sections and define living hinges at the junctions thereof whereby the sections may be folded over each other in order to collapse the module for purposes of storage or shipment, or folded out to erect the module for purposes of assembly.

18 Claims, 52 Drawing Figures

Fig. 5.
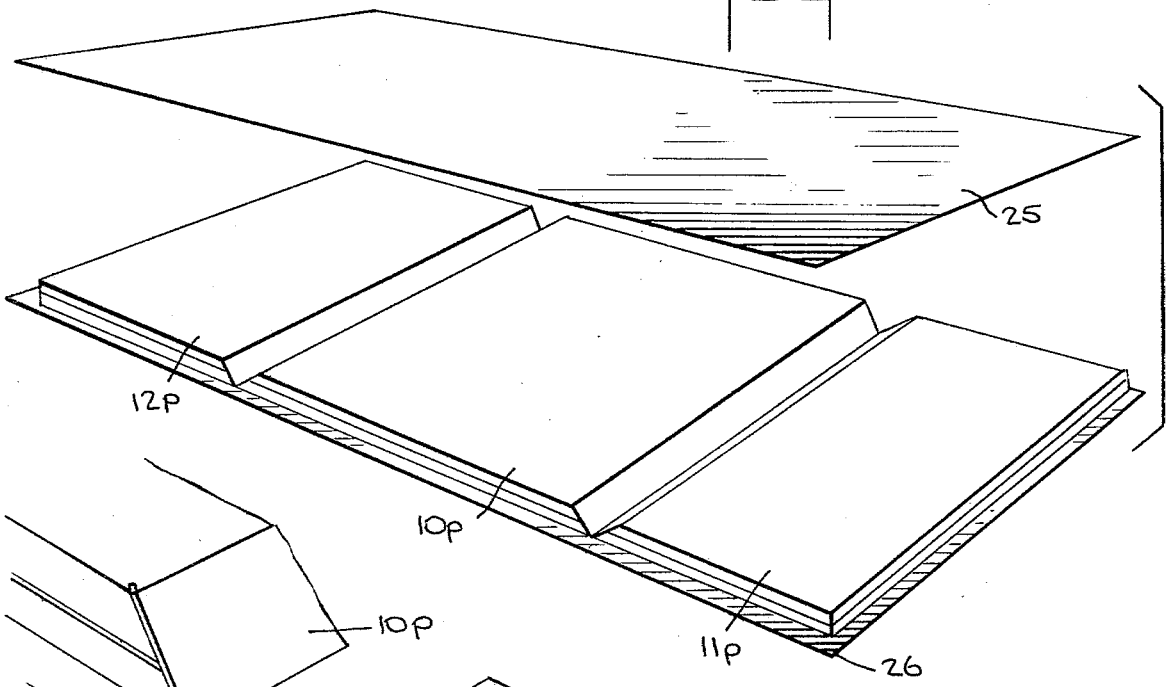
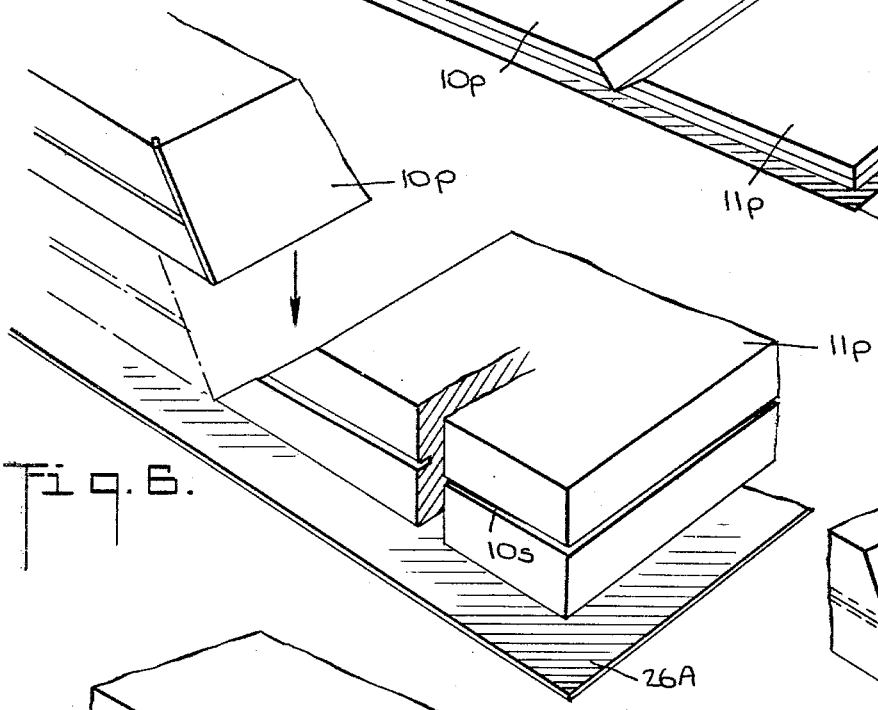
Fig. 6.
Fig. 8.
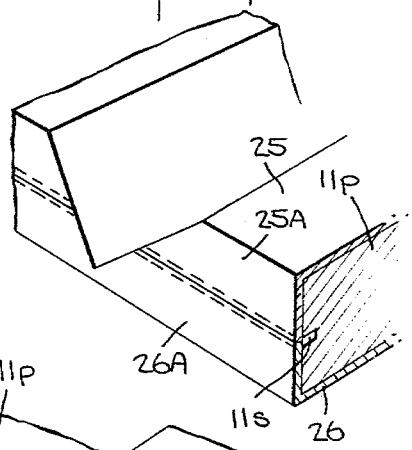
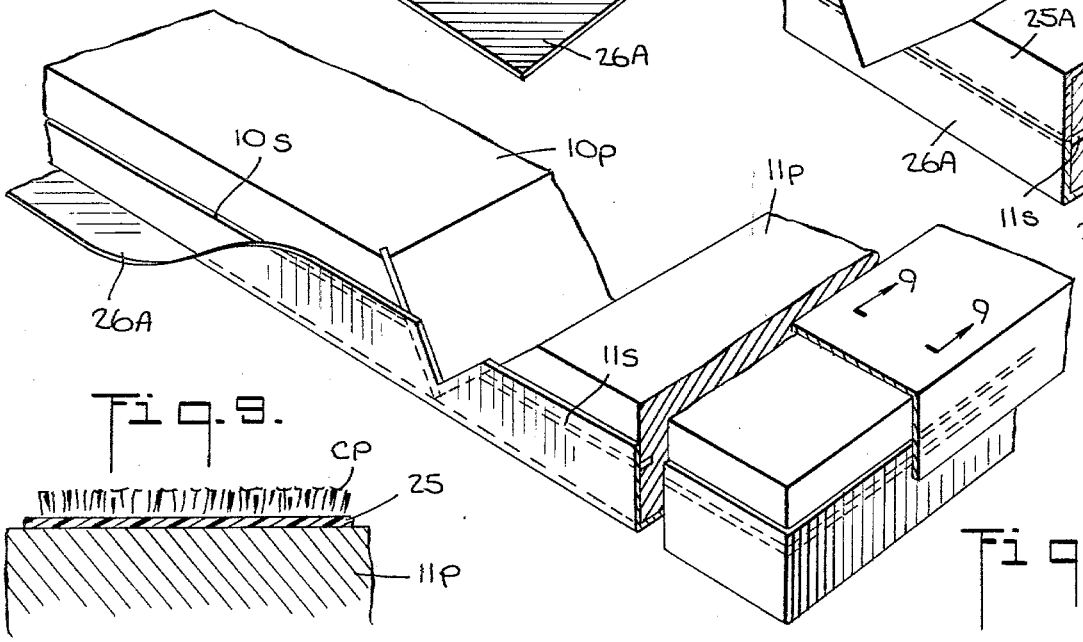
Fig. 9.
Fig. 7.

Fig. 20.
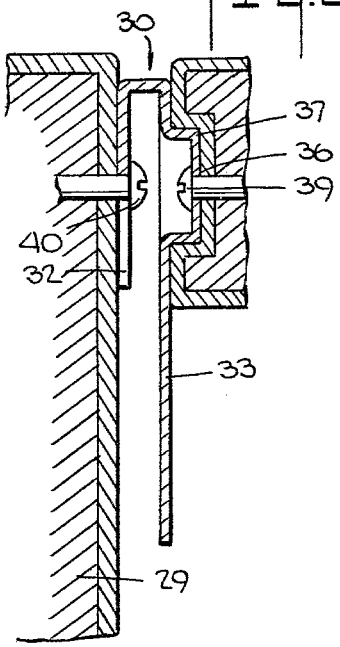
Fig. 17.
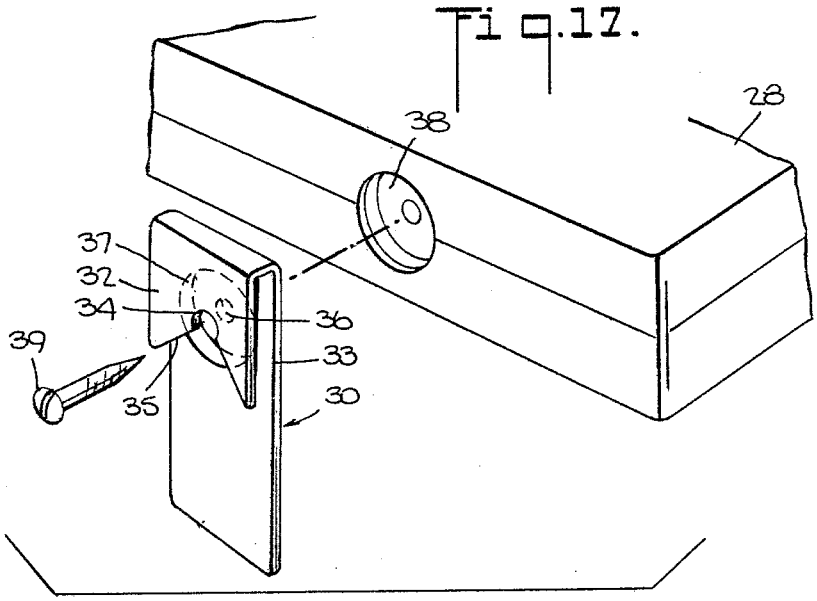
Fig. 18.
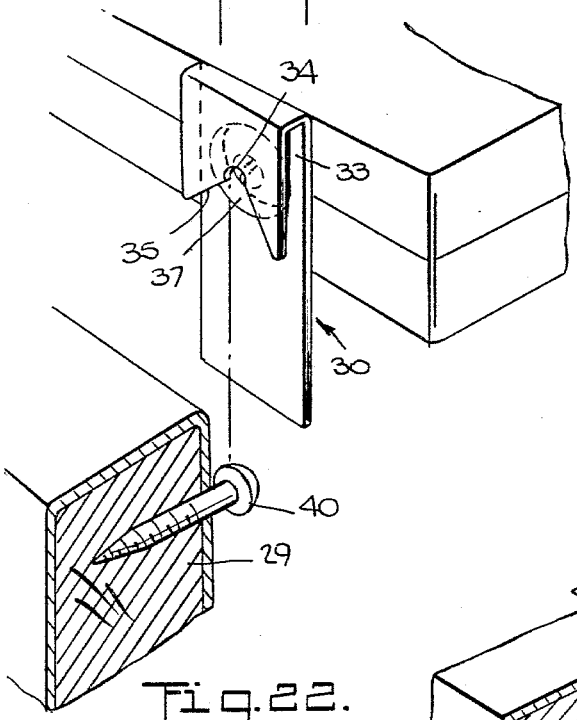
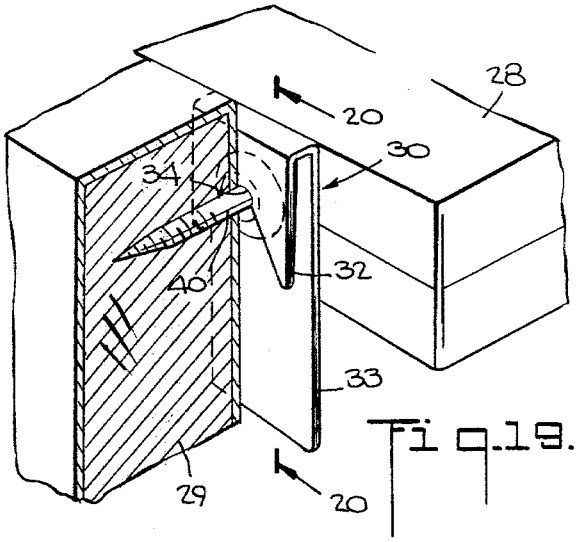
Fig. 19.
Fig. 22.
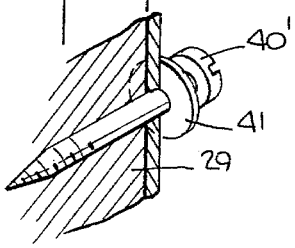
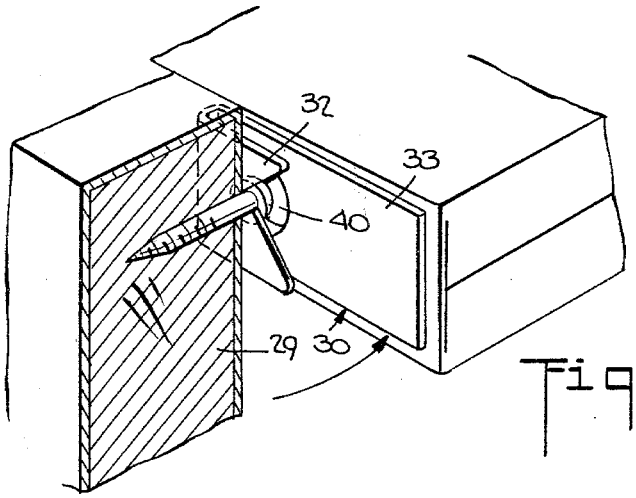
Fig. 21.

Fig. 23.
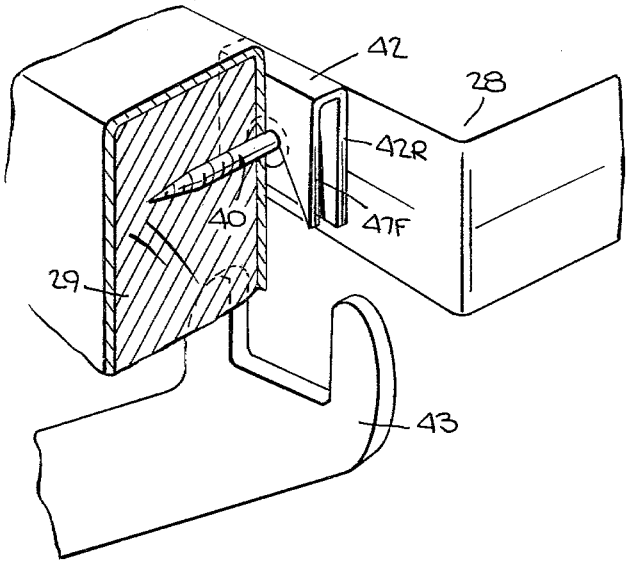
Fig. 24.
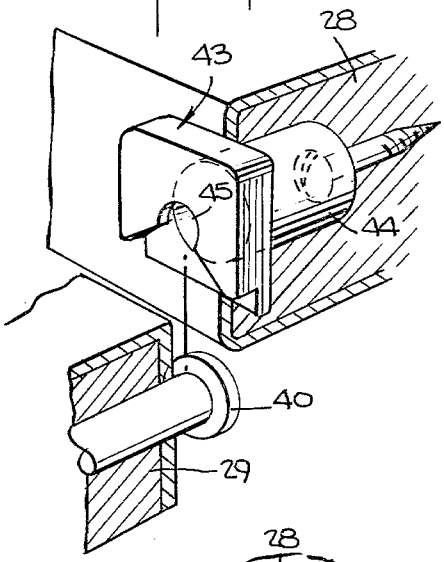
Fig. 25.
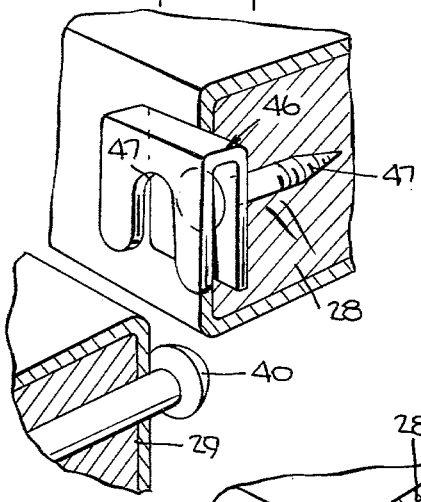
Fig. 26.
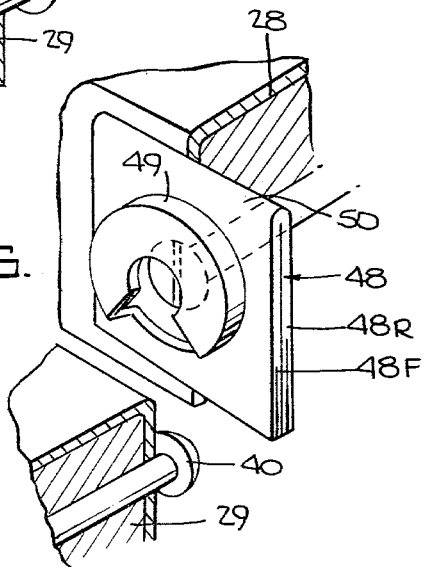
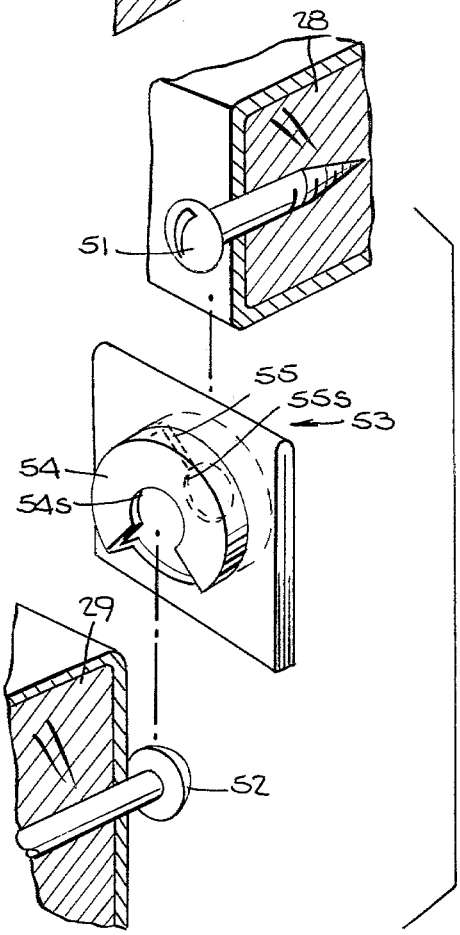
Fig. 27.

Fig. 30.
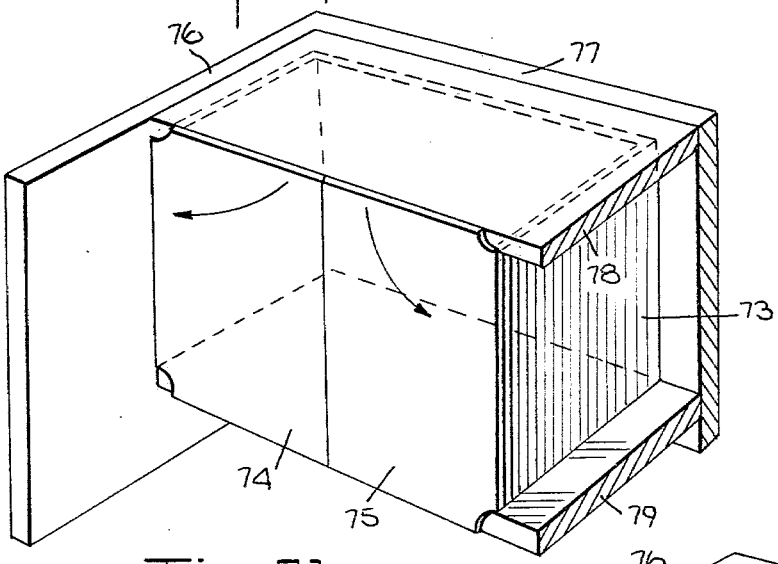
Fig. 35.
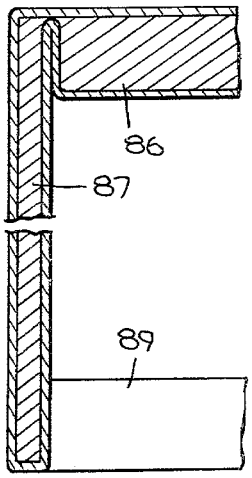
Fig. 31.
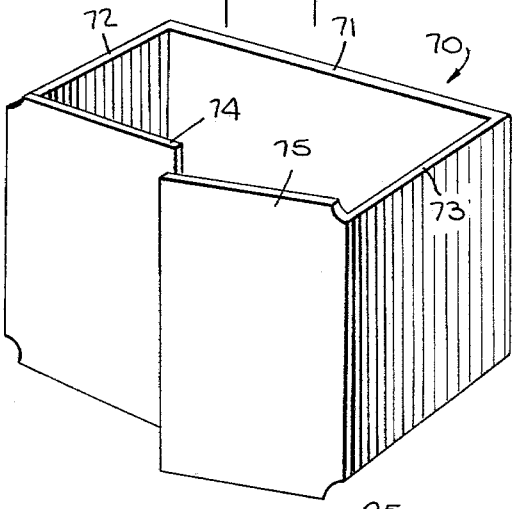
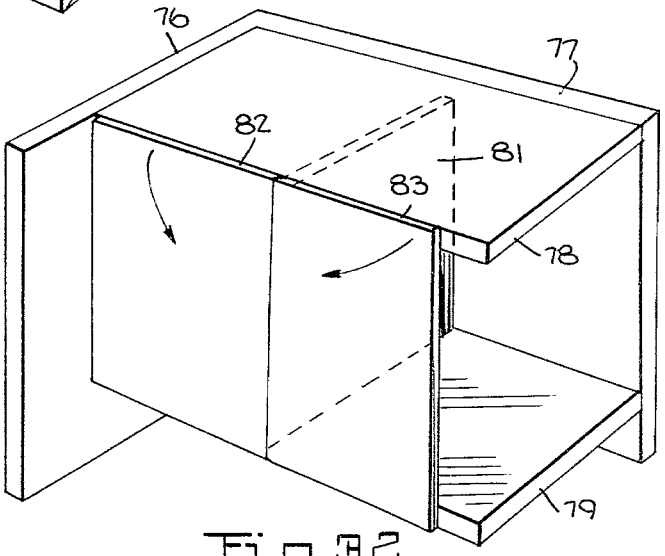
Fig. 32.
Fig. 34.
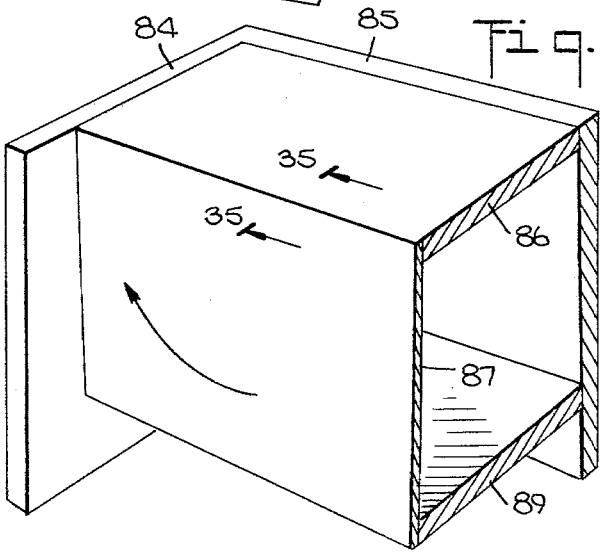
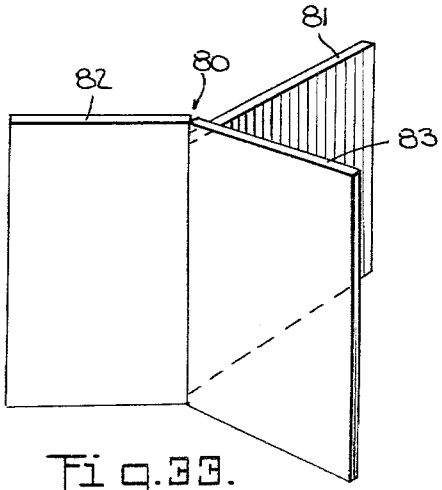
Fig. 33.

Fig. 36.
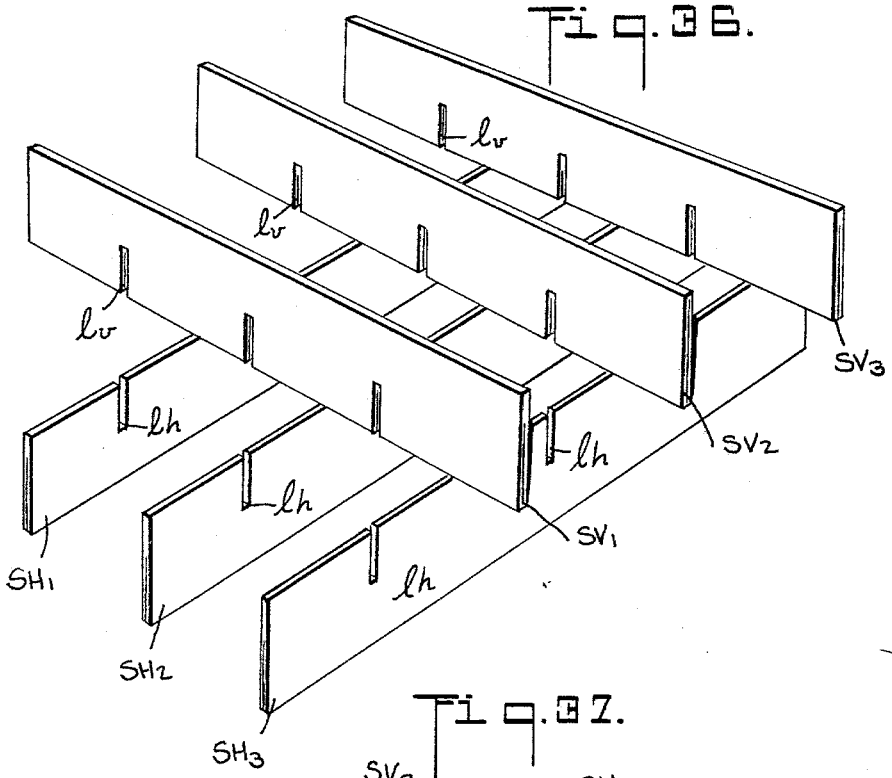
Fig. 38.
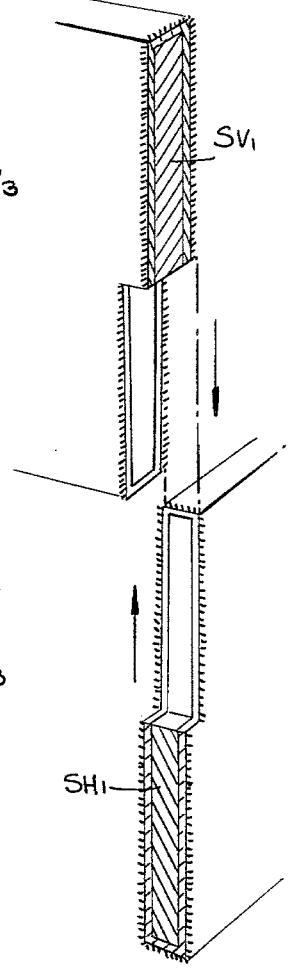
Fig. 37.
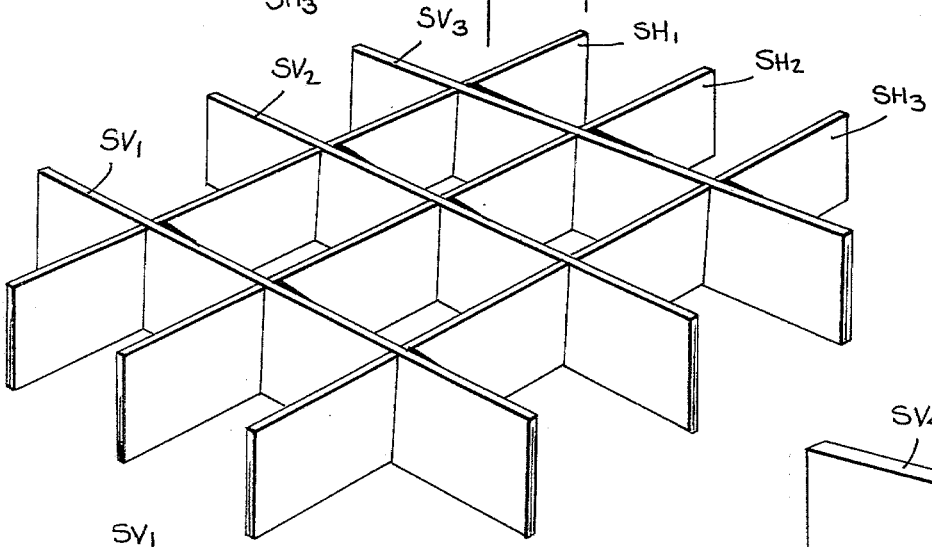
Fig. 39.
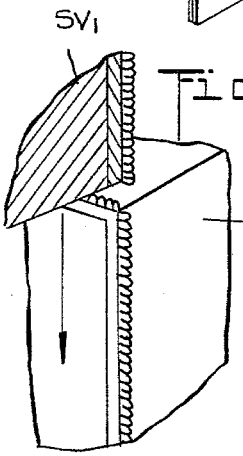
Fig. 40.
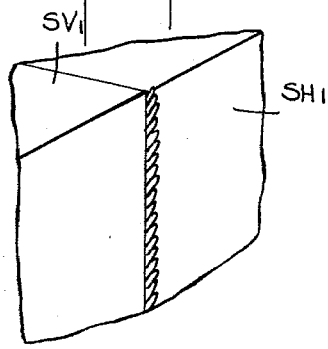
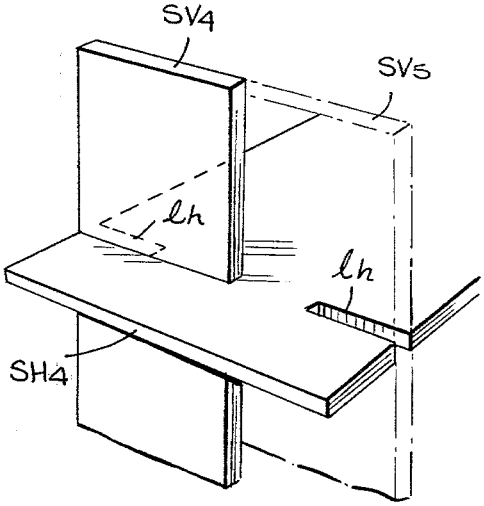
Fig. 41.

Fig.42.
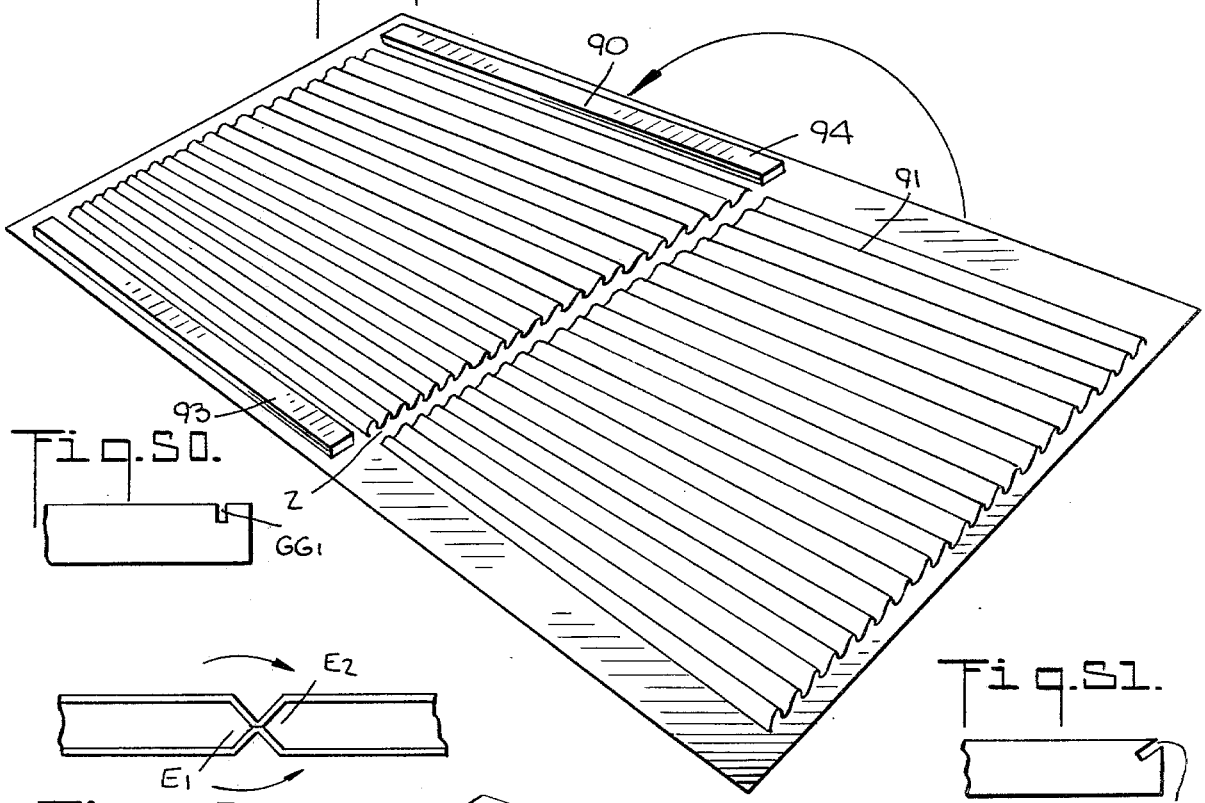
Fig.50.
Fig.52.
Fig.51.
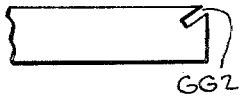
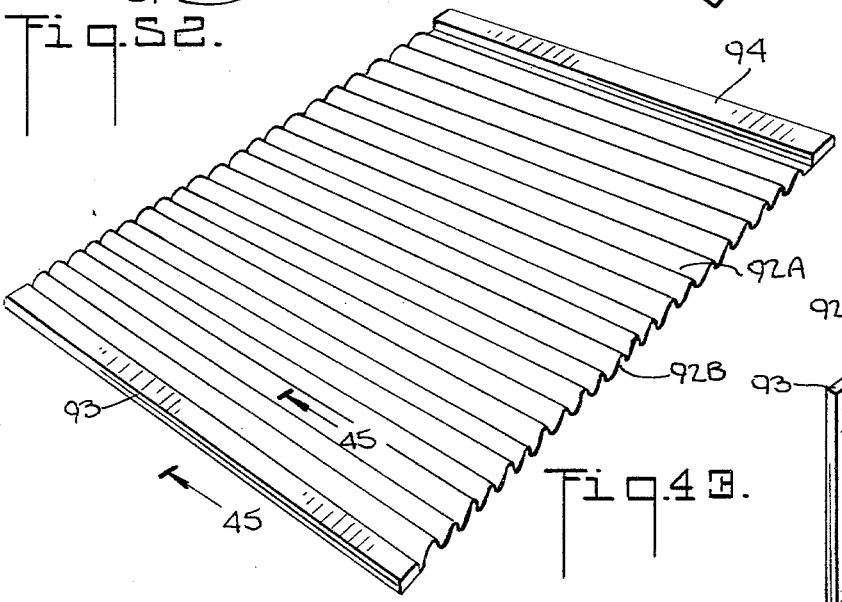
Fig.43.
Fig.44.
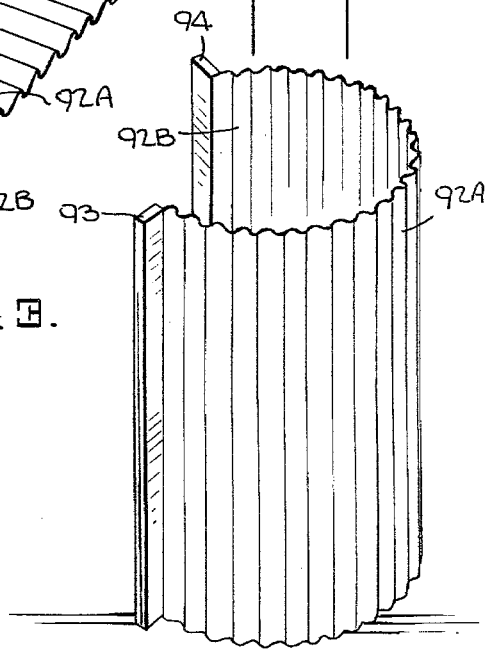
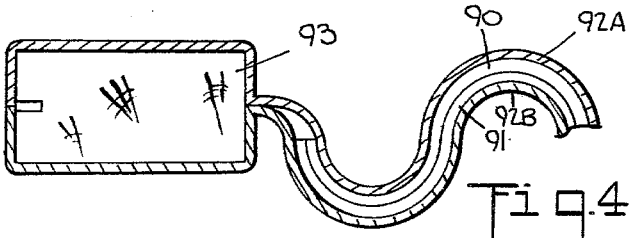
Fig.45.

Fig. 47.
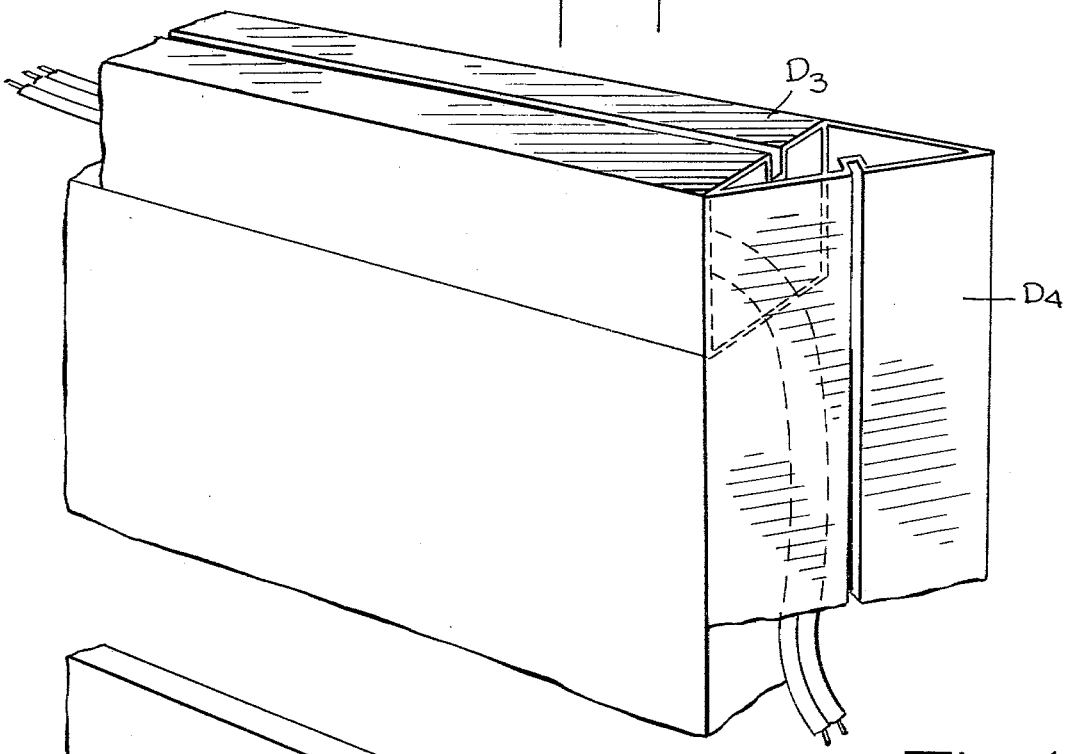
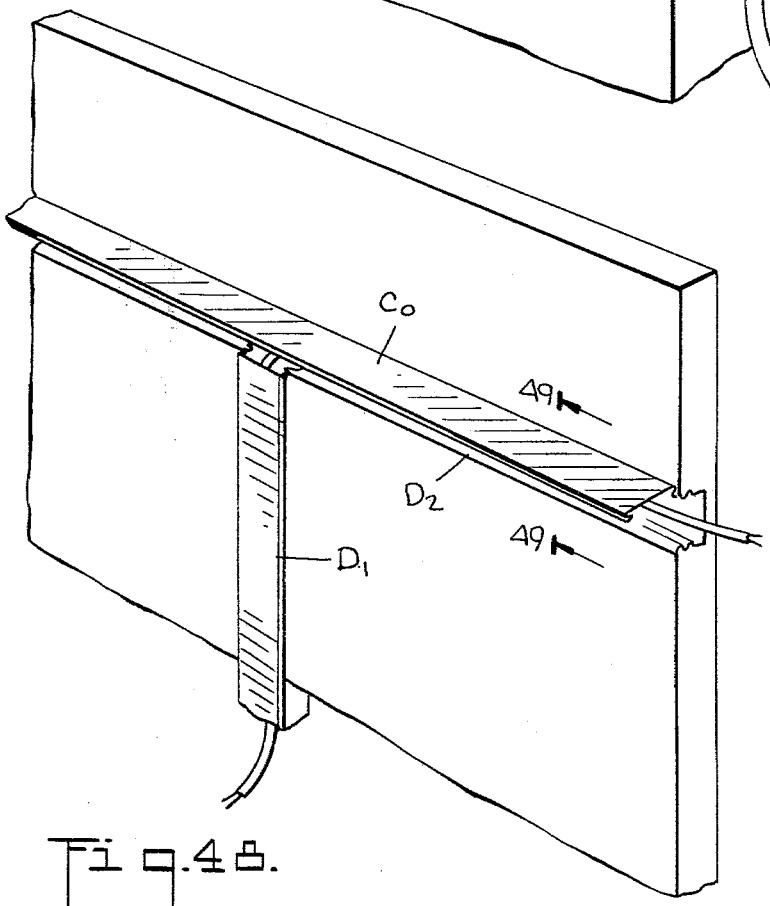
Fig. 48.
Fig. 49.
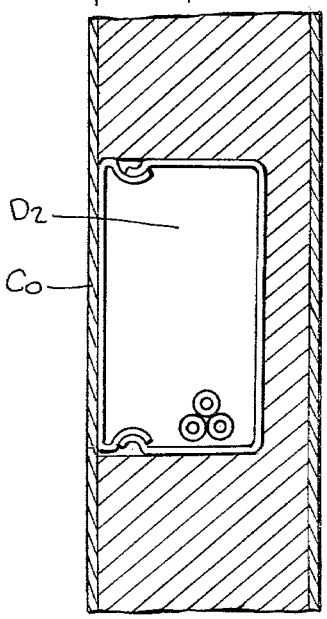

FURNITURE SYSTEMS

BACKGROUND OF INVENTION

This invention relates generally to the field of furniture, and more particularly to a novel furniture system in which articles of furniture which, though in a range of diverse forms and designs, are each constituted by a basic, multi-section structural module that when erected, acts to define the vertical side panels of the piece, the panels being bridgeable by removable shelves, tops and other horizontal components in a manner depending on the predetermined form and design of the piece.

In traditional techniques for fabricating furniture articles such as desks, tables or work stations, the side panels, legs, tops and all other components thereof are permanently joined together at the factory to create a three-dimensional rigid structure. In order, therefore, to box a traditional piece of furniture for handling, storage and shipment, the carton or crate for this purpose must be dimensioned to fully enclose the piece. And to further protect the piece, interior padding, cushioning and other expedients are required.

Thus the selling price to the purchaser of household, office or industrial furniture is predicted not only on materials and production costs, but also necessarily takes into account crating, handling and shipping expenses. The volume occupied by a three-dimensional piece of furniture, even one consisting simply of a rectangular table top and four thin legs, is usually substantial. Since shipping charges are generally based on volume as well as weight, a large piece of conventionally produced furniture may cost almost as much to crate and ship as it does to manufacture.

Moreover, when a crated article of furniture is received at its ultimate destination, it must be uncrated, care being exercised not to damage the piece in the process of doing so. This is a time-consuming procedure, further complicated by the fact that the customer also has to dispose of the dismantled crate or carton.

Because of the many problems involved in handling and shipping conventionally-produced articles of furniture, the trend in recent years has been toward knock-down or modular furniture constructions. Such furniture can be mass-produced in component form and boxed and shipped in a flat disassembled state, thereby effecting significant economies in storage, shipping and handling costs. Pieces of this type are designed for ready assembly at their ultimate destination by means of bolts, bracket, braces and other connecting and reinforcing elements.

But the advantages of knock-down or modular furniture is more or less offset by the fact that when assembled, such pieces often present an unattractive or unfinished appearance by reason of exposed bolts and other connecting hardware. Furthermore, the resultant structure may lack the strength and stability of conventional pieces of similar form made with permanently-bonded joints. Also, with knock-down furniture of the type heretofore known, the hardware therefor must be carefully inventoried. Should a purchaser receive wrong hardware or an inadequate amount of connectors, the article cannot be properly assembled. And because of the many different types of hardware usually entailed in assembling a typical knock-down piece of furniture, assembly procedures are complicated and it is difficult to keep track of hardware.

Also of growing concern in the field of furniture design is the increasing scarcity of high quality lumber and the rising cost of such material. To reduce furniture cost and yet provide attractive furniture articles, it is sometimes the practice to make these of relatively inexpensive unfinished wood core panels having fabric or plastic facings laminated thereto, thereby concealing core defects. But furniture pieces made with laminated panels of this type do not readily lend themselves to knock-down and modular design.

Another factor that must be considered, particularly in office furniture design, is versatility and flexibility. In modern corporate life, changes are frequently made in production, marketing and accounting strategies to cope with new situations. The need therefore often arises at corporate facilities to rearrange the existing set-up of work stations, desks, room dividers and all other appurtenances of the facility in a new configuration that is conducive to expediting the newly-adopted plan. Also, in some instances it may be necessary to transfer these appurtenances from one corporate site to another.

Traditional office furniture systems are ill adapted for this purpose, for they are inherently inflexible. For example, is a decision is made at corporate headquarters to shift the entire accounting department from the third floor to the fifth floor presently occupied by the engineering department, and to move the latter department to another building, with traditional furniture systems this changeover represents a formidable task that is difficult to carry out in short order, however urgent the need to do so with a minimum of dislocation and loss of time.

SUMMARY OF INVENTION

In view of the foregoing, the main object of this invention is to provide an efficient and flexible furniture system which makes use of a basic, multi-section module combinable with horizontal components such that when the module is erected, it acts to define vertical side panels which are then bridged by these components to create a stable yet lightweight structure of high strength.

An important feature of a system in accordance with the invention is that it may be quickly assembled to form an article of furniture, which article may just as quickly and without difficulty be disassembled when the need to do so arises. Thus when it is decided to transfer a corporate department from one floor to another, the various pieces of furniture which are installed in this department can be disassembled and transported in the flat state by elevator to the new location and there reassembled without any significant loss of operating time.

More particularly, it is an object of this invention to provide a system of the above-noted type adapted to create a diverse range of furniture articles, the multi-section module being constituted by three or more rectangular core panels in side-by-side relation to whose faces are laminated fabric layers that serve to interconnect the sections and define living hinges at the junctions thereof, making it possible to fold the sections in order to collapse or erect the module.

A salient advantage of the system in accordance with the invention is that the basic, fabric-covered module can be compactly stored and shipped in a flat state with the folded sections thereof in superposed relation, thereby reducing storage, shipping and handling costs. And because of the fabric layers, the module is self-protective and can be contained in a simple carton or merely wrapped.

Moreover, the fabric layers of a module in accordance with the invention impart sound-absorbent properties to the pieces. Thus an office or other facility having several such pieces placed therein has distinct acoustic advantages over the same facility filled with traditional metal, wood or plastic-covered furniture having poor sound-absorbing characteristics.

Because the appearance and wearing qualities of an article of furniture made in accordance with the invention are mainly determined by pile carpet layers, these factors are directly controlled by the designer who can select appropriate carpet materials and colors. And since the core panels are concealed by the carpet layers, these may be formed of low-cost wood panels of good strength, or hollow panels of framed construction, or those which are composites of wood and foam plastic materials thereby reducing the weight of the module, or those which include extruded or corrugated metal.

An important feature of the present invention is that it entails a minimal amount of assembly hardware, the primary assembly procedure using simple low-cost metal fasteners, all of which are identical.

Also an object of the invention is to provide improved fasteners to facilitate the attachment of the horizontal components to the vertical side panels of the multiple-section module.

Still another object of the invention is to provide flexible screens and dividers which are covered with carpet layers and present a surface appearance matching that of a furniture system in accordance with the invention.

Briefly stated, these objects are accomplished in a furniture system constituted by a basic, multi-section structural module that when erected acts to define the vertical side panels of a piece having a predetermined form and design. The erected module is combinable with removable shelves, tops, and other horizontal components adapted to bridge the side panels and to rigidify the structure in a manner depending on the form and design thereof.

The multi-section module is created by three or more rectangular core panels in side-by-side relation to whose opposing faces are laminated fabric layers formed of stretchorientable synthetic fibers such as polyolefin fibers that serve to interconnect the section and define living hinges therefor. The fabric-covered sections may be folded over each other to collapse the module for purposes of storage and shipment, or folded out to erect the module for purposes of assembly. In practice, the fabric layers may be of non-woven or woven synthetic or natural fibers, and preferably in the form of a fabric or carpet having a compressible pile or fuzzy surface.

The ends of the horizontal components are provided with fastener cleats that cooperate with studs anchored on the side panels of the erected module, whereby a component may be put in place simply by bringing it down within the alcove or other bay defined by the erected module until the cleats engage the studs. In a preferred embodiment of the invention, the fastener cleats, after the horizontal component is in place, may be rotated to lock the studs therein, so that the horizontal component cannot be removed without first causing a reverse rotation of the cleats.

OUTLINE OF DRAWINGS

For a better understanding of the invention as well as other objects and further features thereof, reference is made to the following detailed description to be read in conjunction with the accompanying drawings, wherein:

FIG. 5 illustrates the relationship of the core panels of the work station module to the carpet layers laminated thereto;

FIG. 6 is an enlargement of two of the core panels of the module lying on a carpet layer before the margin of this layer is folded over and bonded to the edges of the core panels;

FIG. 7 shows the margin of the carpet layer when folded over and laminated to the edges of the core panels;

FIG. 8 shows the junction between two core panels after the carpet layers have been bonded thereto;

FIG. 9 is a section taken on the plane indicated by line 9—9 in FIG. 7;

FIG. 17 illustrates, in perspective, the manner in which the cleat of a fastener in accordance with the invention is mounted on the edge of a horizontal component of the system;

FIG. 18 shows the mounted cleat and the cooperating stud anchored on a section of the module;

FIG. 19 shows the cleat resting on the stud to link the component to the module section;

FIG. 20 is a sectional view taken in the plane indicated by line 20—20 in FIG. 19;

FIG. 21 shows the cleat after it has been turned 90 degrees to lock the stud thereto;

FIG. 22 illustrates an alternative form of stud;

FIG. 23 shows a second version of the fastener;

FIG. 24 shows a third version of the fastener;

FIG. 25 shows a fourth version of the fastener;

FIG. 26 shows a fifth version of the fastener;

FIG. 27 shows a sixth version of the fastener;

FIG. 30 shows a cabinet attachment for a desk, the attachment having swinging doors and being inserted between a pair of horizontal components;

FIG. 31 shows the cabinet attachment separated from the horizontal components;

FIG. 32 shows a partition attachment provided with swinging doors and insertable between a pair of horizontal components;

FIG. 33 shows the partition attachment separated from the horizontal components;

FIG. 34 is a perspective view of a horizontal component having a folding lead which functions as a lift-up door when used in combination with a parallel horizontal component;

FIG. 35 is a transverse section taken in the plane indicated by line 35—35 in FIG. 34;

FIG. 36 is a perspective view of a cellular storage unit in accordance with the invention, and formed by a parallel array of horizontal slats and a parallel array of vertical slats, the two arrays being shown prior to assembly;

FIG. 37 shows the cellular storage unit in the assembled state;

FIG. 38 illustrates the manner in which a slat from the horizontal array is joined to a slat from the vertical array;

FIG. 39 is a more detailed showing of the slats being joined;

FIG. 40 shows the junction of the slats;

FIG. 41 is another form of cellular storage unit having double the capacity of the first unit;

FIG. 42 shows how a flexible screen or divider in accordance with the invention is fabricated;

FIG. 43 shows the finished divider in its flat state;

FIG. 44 shows the finished divider in its curved state;

FIG. 45 is a sectional view taken in the plane indicated by lines 45—45 in FIG. 43;

FIG. 47 illustrates the manner in which wiring ducts are attached to the edge of a module section;

FIG. 48 shows how wiring ducts are embedded in a module section;

FIG. 49 is a section taken in the plane indicated by line 49—49 in FIG. 48;

FIG. 50 shows a portion of a module core panel with a slot indented in the top face thereof to provide a cutting guide for trimming the fabric layers laminated to the panel;

FIG. 51 shows a portion of a module core panel with a slot indented at the upper corner of the panel edge to provide a cutting guide for trimming the fabric layers laminated to the panel; and FIG. 52 shows two core panels in side-by side relation with their adjacent edges mitered in a triangular formation whereby the section of the module may be folded in either direction.

DESCRIPTION OF INVENTION

Work Station

Figure 1:
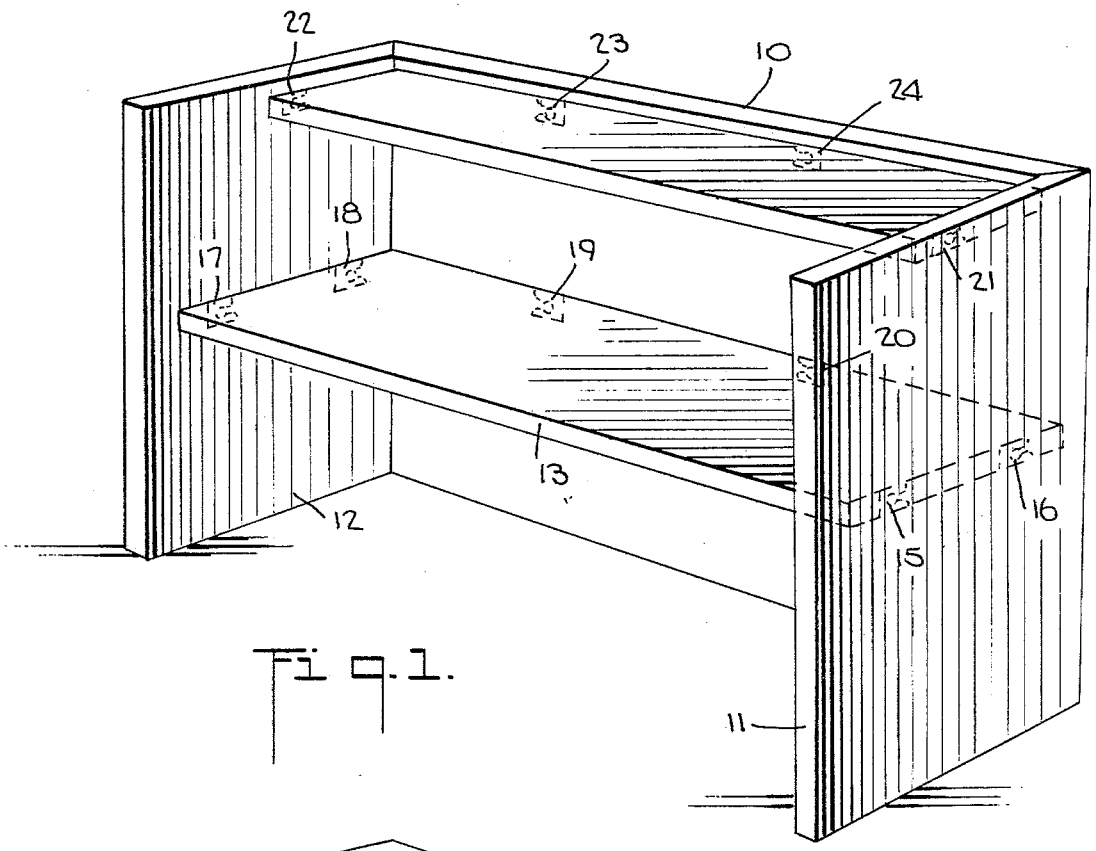
FIG. 1 is a front perspective view of a work station formed from a furniture system in accordance with the invention.

Referring now to FIG. 1, there is shown by way of example a work station derived from a furniture system in accordance with the invention. The system is constituted by a multi-section module formed by a center section 10 and two wing sections 11 and 12 hinged to opposite sides thereof. The adjacent edges of the sections are mitered so that when the wing sections are folded in they form a right angle with the center section to create an alcove. Combinable with the erected module are horizontal components which in the work station illustrated consist of a table top component 13 and a shelf component 14.

The module is formed of wood core panels in side-by-side relation to whose faces are laminated fabric layers. The structural nature of the module and the manner in which it is formed will be later described in greater detail. The horizontal components may take the form of wood pieces or pieces having carpet layers laminated thereto. Thus while the module is always fabric covered, this is optional for the horizontal components and therefore opens up different design possibilities. To improve the acoustic properties of the module, the core panels may be of framed construction to enclose an acoustic batting of fiberglass or similar material.

Table top component 13 bridges wing sections 11 and 12 at a level somewhat above the midpoint of these sections, while shelf component bridges the same sections at a level close to the upper end thereof. To connect table component 13 to the wing sections of the module, it is provided with two pairs of cleats 15–16 and 17–18 on either end, and a third pair of cleats 19 and 20 on its inner edge. These cleats engage studs anchored in the sections of the module in a manner to be later described. To connect shelf component 14 to the sections of the module, it is provided with a single cleats 21 and 22 on either end and a pair of cleats 23 and 24 on the inner edge.

Figure 2:
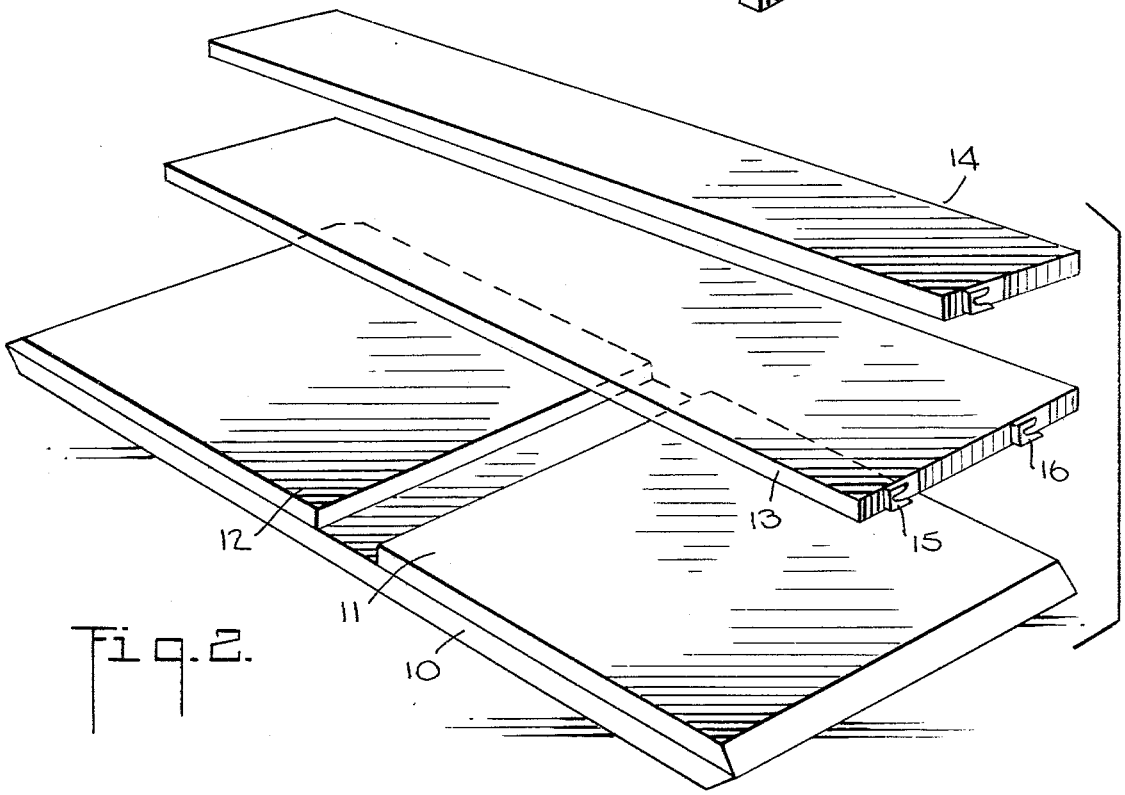
FIG. 2 shows the system in its collapsed state, the system consisting of a module and two horizontal components combinable therewith.

As shown in FIG. 2, in the collapsed or flat state of the module, wing sections 11 and 12 are folded over center section 10. Placed on the folded module are the table top and shelf components 13 and 14, so that the resultant stack may be boxed in a shallow carton for storage and shipment or simply wrapped and tied.

Figure 3:
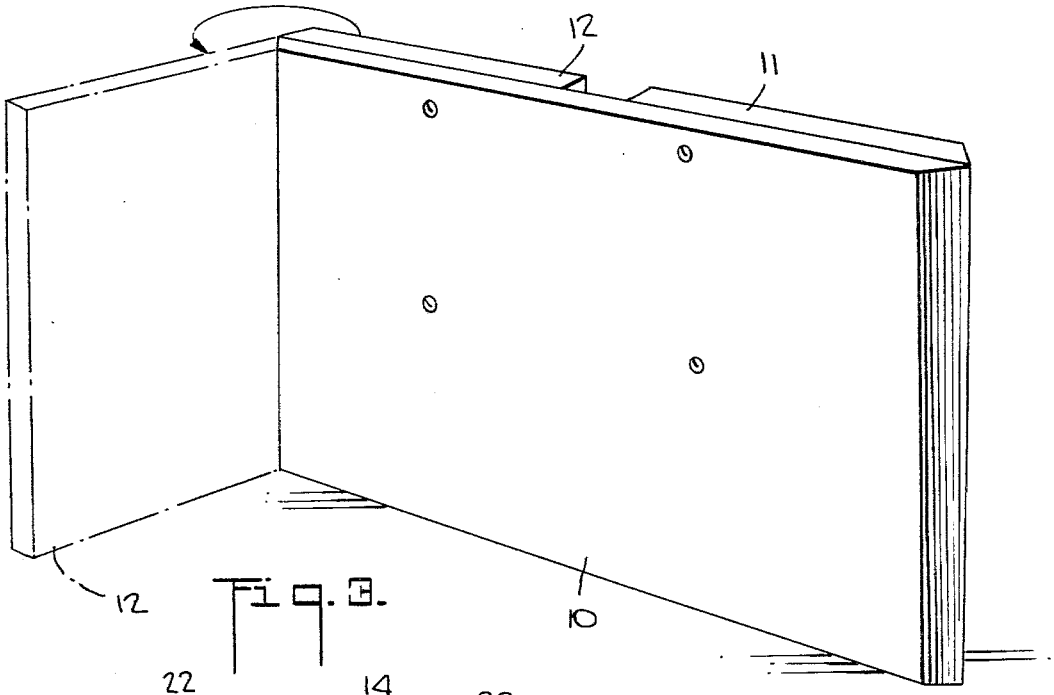
FIG. 3 shows the module being erected to form an alcove.
Figure 4:
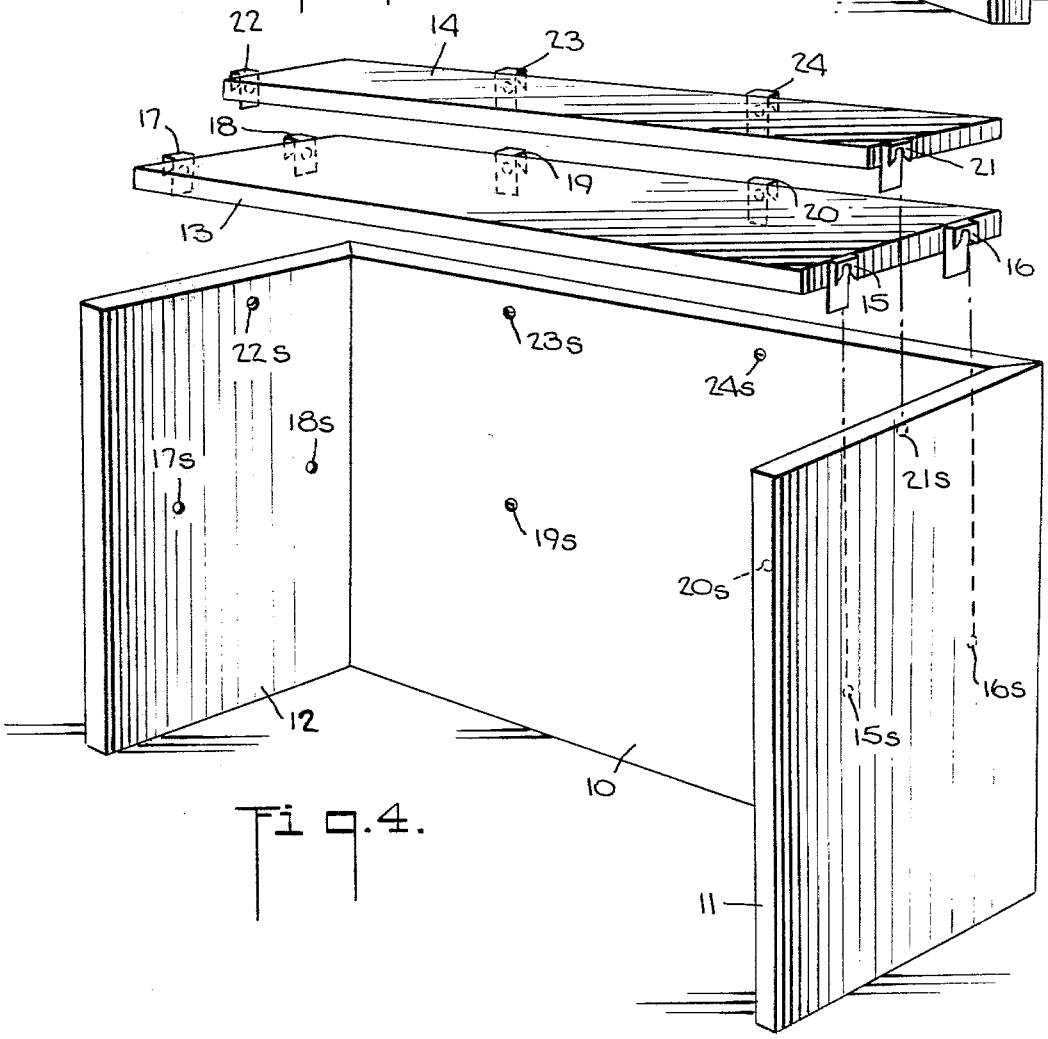
FIG. 4 shows the horizontal components being put in place in the alcove.

It will be seen in FIGS. 3 and 4 that when the structural module in its flat state is raised and its side wings folded in, the resultant alcove is formed by a vertical center section 10 and the two vertical wing sections 11 and 12 at right angles thereto. Center section 10 is provided with a pair of studs 19S and 20S at positions engageable by the inner edge cleats 19 and 20 of top component 13, while wing sections 11 and 12 each have a pair of studs 15S–16S and 17S–18S at positions engageable by end cleats 15–16 and 17–18. The sections of the module are also provided with studs 21A, 22S, 23S and 24S which cooperate with correspondingly-numbered cleats on shelf component 14.

Each cleat is provided with a stud-engaging slot and is screwed to its component so that it can be rotated from a position, as shown in FIG. 4, in which the longitudinal axis of the cleat is in the vertical direction so that its slot faces a stud to a position, as shown in FIGS. 1 and 2, where the longitudinal axis of the cleat is in the horizontal direction to lock the stud therein.

Hence when the longitudinal axes of the cleats are in the vertical direction, a horizontal component bearing these cleats may be brought down within the alcove defined by the sections of the module until the studs thereof are received within the slots of the corresponding cleats, thereby retaining the component at the level of the studs. The cleats are then rotated 90° by a suitable wrench-like tool to lock in the studs. The structure of the cleats and studs will be described in greater detail in a subsequent section of the specification.

The cleats project from the edges of the horizontal components. When the cleats are coupled to the studs on the module, they create a small gap between the edges of the horizontal components and the sections of the module. But because the sections of the module are covered by carpet layers whose pile is subjected to pressure when a horizontal component is put in place, the gaps are concealed by the carpet pile to afford a finished appearance that is normally not attainable in knock-down furniture which is put together with fasteners.

Fabrication of Module

The manner in which a work station module of the type shown in FIG. 3 and composed of a center section 10 and wing sections 11 and 12 is fabricated is illustrated in FIGS. 5 to 9.

This module is formed by three rectangular wood core panels 10P, 11P and 12P in side-by-side relation. The core panels are all of the same thickness and width. However, the breadth of core panel 10P is greater than that of side panels 11P and 12P, for these panels serve to form the center section 10 and the wing sections 11 and 12, respectively, of the work station. As will be evident from other figures, the number of core panels and their dimensions are determined by the number and size of the sections which make up a given module. The dimensions of these core panels are dictated by the form and design of the article of furniture to be created thereby.

The adjacent edges of core panels 10P, 11P and 12P are mitered so that when the sections formed thereby are folded in, the wing sections are then at right angles to the center section to define an alcove. However, the miter angle of the core panels may be such as to produce angles other than 90 degrees when the sections are folded in, depending, of course, on the form and design of the furniture piece to be established by the module. However, regardless of the miter angle, when one section is folded over another, it lies flat thereon.

As best seen in FIG. 5, the panels are sandwiched between layers 25 and 26 of carpet material which are laminated by suitable bonding agents to the opposing faces of the core panels to interconnect these panels and to define living hinges at the junctions thereof. These carpet layers are preferably fabricated of non-woven fabric of synthetic plastic fibers formed of polypropylene, nylon or other stretch-orientable polymeric material whose tensile strength is enhanced by molecular orientation caused by stretching the filamentary material from which the fiber is made to a point short of its elastic limit. The preferred carpet material is of the needlepunch type in which a carpet pile is created by passing a web of non-woven material under a bank of reciprocating needles which acts to pull up fibers from the web. The pile CP of carpet layer 25 laminated to core panel 11P is shown in FIG. 9.

The dimensions of the carpet layers relative to the overall rectangular area occupied by the side-by-side core panels are such as to provide carpet margins which extend beyond this area. As shown in FIG. 6, carpet layer 26 is provided with a margin 26A. In order that the carpet layers cover not only the faces of the core panels but also their edges, it is necessary that the margins of these layers be folded over the edges and bonded thereto. And in order that the carpet-covered edges have a finished, seemingly seamless appearance, it is essential that the ends of the carpet margins of the opposing carpet layers 25 and 26 lie in abutting relation.

To achieve this result, the core panels, as illustrated by core panels 10P and 11P in FIG. 7, are provided at their long edges with longitudinally-extending center slots which in this figure are represented by slots 10S and 11S. It is therefore not necessary to cut the carpet layers to exact dimensions, for the dimensions may be such as to provide margins, such as margins 26A, which when folded over the edge of the core panels, extend more or less beyond the slots therein.

Figure 10:
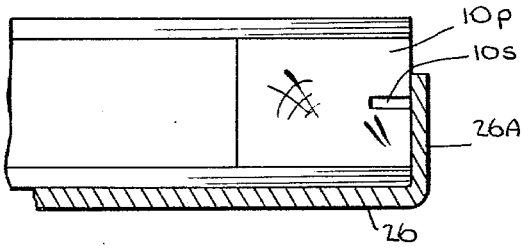
FIG. 10 shows the margin of one of the carpet layers folded over the edge of a core panel and its overlapping relationship to a slot formed in this edge.
Figure 11:
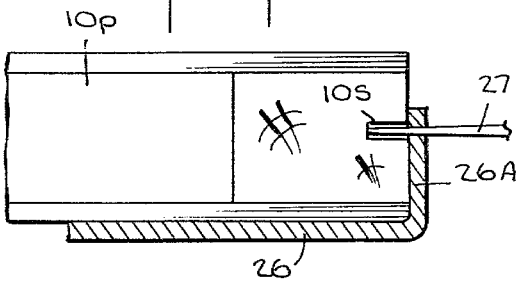
FIG. 11 is similar to FIG. 10 except for a blade which enters the slot to sever the excess margin.

Thus as shown in FIG. 10, when margin 26A is folded over and bonded to cover panel 10P, it extends somewhat beyond slot 10S therein. Then, by means of a rotary blade 27, as shown in FIG. 11, which is forced into slot 10S, the excess margin is trimmed off, so that now the edge of margin 26A is coincident with the slot.

Figure 12:
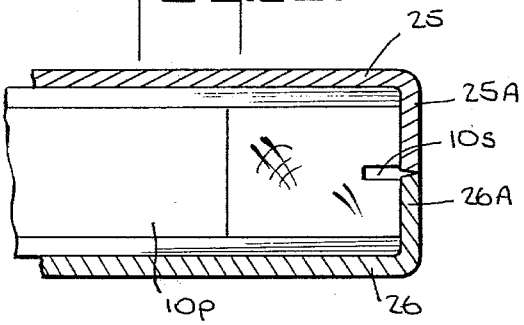
FIG. 12 is also similar to FIG. 10, save now the margins of both layers folded over the edge have been severed to form a finished carpet edge covering.

The same steps are taken with respect to margin 25A of carpet layer 25. Thus, as shown in FIG. 12, the edges of margins 25A and 26A after being trimmed are coincident with slot 10S and are in abutting relation to provide a finished appearance.

Figure 13:
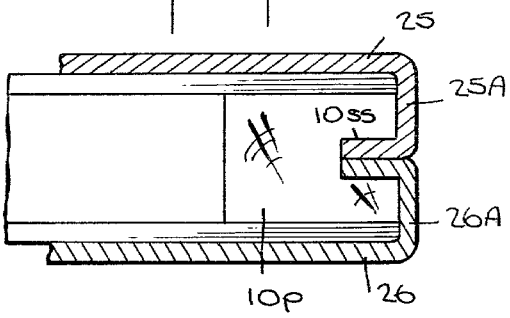
FIG. 13 shows an alternative approach for providing a finished edge carpet.

An alternative approach to obtaining a finished covered edge is shown in FIG. 13, where instead of cutting the excess from margins 25A and 26A, these excess margins are stuffed into slots 10SS which are sufficiently large to accommodate both excess margins.

While solid core wood panels are shown, in practice these panels may be of hollow frame construction to provide a lighter module. Alternatively, the core panels may be composites of wood, plastic and other materials. Since the core panels are concealed, their appearance is of no importance, and one can therefore choose core panel materials which are of relatively low cost, even though of adequate structural strength.

Folding Characteristics

Figure 14:
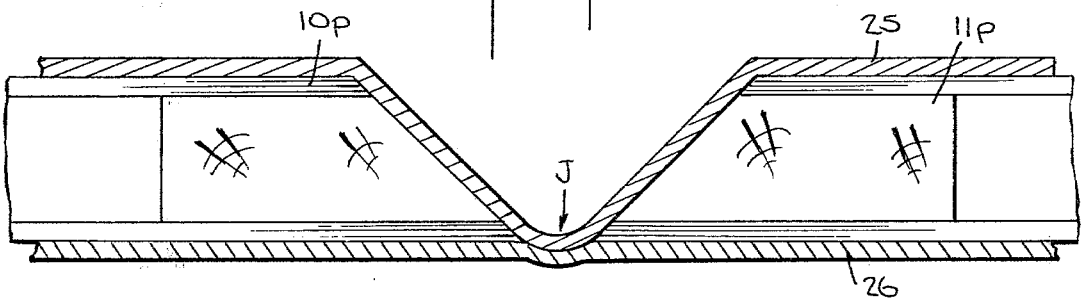
FIG. 14 illustrates the relationship of the two carpet layers at the hinged junction of two sections of the module when the sections are in side-by-side relation.

As shown in FIG. 14, when the core panels of the module which are in side-by-side relation, such as panels 10P and 11P, are interconnected by carpet layers 25 and 26 laminated to the opposing faces of these panels, the resultant junction J between adjacent core panels is constituted by carpet layers 25 and 26 which are joined at this junction. Layer 25 conforms to the mitered edges of the panels to form a trough at junction J.

Thus carpet layers at junction J act as a living hinge, and because the carpet material is of synthetic fibers which are stretch orientable, repeated folding at the junction does not weaken but acts actually to strengthen the junction. This is a distinct advantage as compared, say, to conventional hinges of spring metal where repeated flexing would result in work hardening and ultimate fracture of the metal.

Figure 16:
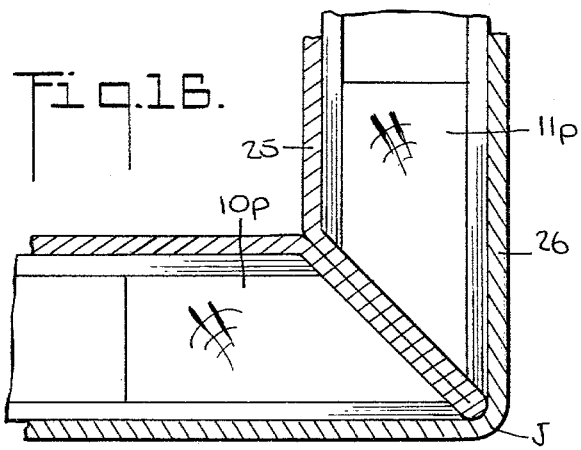
FIG. 16 shows the same junction in the folded-over state.

When, as shown in FIG. 16, the sections formed core panels 10P and 11P are folded in at junction J, the mitered edges of these sections which are covered by carpet layer 25 meet to form a right angle corner. In practice, core panels 10P and 11P are sufficiently spaced from each other to make allowance for the thickness of the carpet layers so that when folded in, the angle is exactly 90 degrees.

Figure 15:
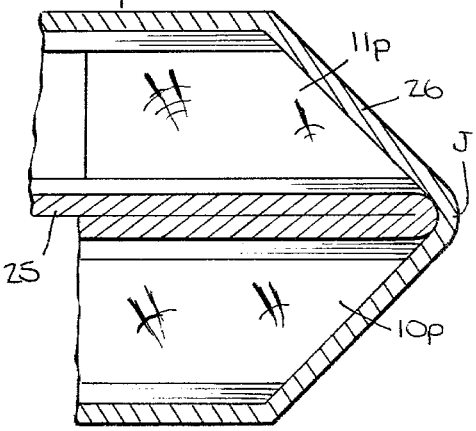
FIG. 15 shows the same junction in the folded-in state.

When, however, the sections formed by core panels 10P and 11P are folded over, as shown in FIG. 15, about junction J, then the sections are superposed. In this flat state, the module may be stored and shipped in compact form.

Fasteners

One preferred version of a fastener for linking a horizontal component 28, as shown in FIGS. 17 to 21, to a section 29 of a multi-section module, makes use of a cleat, generally designated by numeral 30, and a stud 31. Both the horizontal component 28 and the module section 29 are shown as being covered by fabric layers.

Cleat 30 is formed by a rectangular metal strip having a short, bent-over front portion 32 and a parallel rear portion 33 of greater length. The front portion 34 is provided with a slot 35 which converges from the free edge to an arcuate recess 34 at the center of this portion. The rear portion 33 of the cleat is provided with a bore 36 that is in registration with recess 34 and is centered within a circular depression 37.

Circular depression 37 of the cleat is received within a circular well 38 bored in the edge of horizontal component 28, the cleat being secured to this edge by a screw 39 which passes through bore 36 in depression 37. Because of this single screw connection, cleat 30 is rotatable about the screw which acts as a pivot.

Anchored in the module section is a stud 40 having an enlarged head spaced from the surface of the section and adapted to lie within recess 34 of the cleat when the cleat is linked to the stud in the manner shown in FIGS. 19 and 20.

When a horizontal component is to be linked in a section of the module, cleat 30 is initially positioned, as shown in FIGS. 18 and 19, with its longitudinal axis which passes through arcuate recess 34 extending in the vertical direction, this axis being in line with stud 40 in the module section. Hence when the horizontal component is brought down in the direction of stud 40, the stud falls into recess 34 of the cleat, thereby hooking the component onto the module section.

In order to lock this connection, cleat 30 is then rotated by means of a suitable tool so that, as shown in FIG. 27, its longitudinal axis now lies in the horizontal direction. The reason why the horizontal component cannot be displaced in the horizontal plane to withdraw cleat 30 from stud 40 is that such movement is prevented by the back section of the module in which the horizontal component is installed. When one wishes, however, to disassemble the article of furniture, cleat 30 is turned so that its longitudinal axis is again in the vertical direction, making it possible to lift the horizontal component out of the module.

FIG. 22 shows an alternative form of stud 40' which is screwed into module section 29, this stud differing from stud 40 only in that it is provided with an annular flange 41 which rests against the surface of the module section to define a gap between the head of the stud and the surface within which the cleat is received.

The cleat 42 shown in FIG. 23, which cooperates with a stud 40 anchored in module section 29, differs from cleat 30 shown in FIGS. 17 and 18, only in that its parallel front and rear portions 42F and 42R are of the same size rather than of different size, so that the cleat then has a square configuration. This square configuration lends itself to manipulation by a standard wrench 43 which can be used to engage the cleat in the gap between the edge of the horizontal component and the surface of the module section to which it is linked. Wrench 43 acts to turn the cleat to effect a locking or unlocking action.

Still another version of a fastener is shown in FIG. 24, where it will be seen that cleat 43 is in the form of a square metal shell whose base wall is provided with a cylindrical extension 44 which is received within a cylindrical bore in the horizontal component. The shell is profiled to define on its front wall an arcuate recess 45 with a converging entry thereto to receive stud 40.

A simpler version of a cleat 46 is shown in FIG. 25, where it will be seen that the cleat is a metal strip that is bent to define front and rear portions of the same size, the rear portion having a hole for the insertion of a screw 47. The front portion of cleat 46 has an arched slot 47 to receive stud 40. This cleat can be turned to lock the fastener with a standard wrench.

Still another version of the cleat is shown in FIG. 26, where it will be seen that cleat 48 is formed by a strip of metal that is bent to form abutting front and rear portions 48F and 48R, the front portion having a projecting circular shell 49 which is slotted to receive stud 40. The rear portion is provided with a central bore through which a screw 50 is insertable to mount the cleat on the edge of horizontal element 28. The cleat is rotatable on this screw to lock the fastener.

In some instances, it may be desirable not to attach the cleat to the horizontal component, but to provide both this component and the module section 29 with matching studs 51 and 52, as shown in FIG. 27. In this case, cleat 53, which acts to interconnect these studs, is similar to that shown in FIG. 26, except that in addition to a front circular shell 54 having a slot 54S therein whose converging entry is on the lower side thereof, there is a rear circular shell 55 having a slot therein whose converging entry is on the upper side thereof. With this cleat, one first hooks the cleat onto stud 52 of the section of the module, after which the horizontal component 28 is brought down so that its stud 51 is received in slot 55S of the rear portion of the stud. Then by turning the cleat 180 degrees, both studs are locked to the cleat.

Second Work Station

Figure 28:
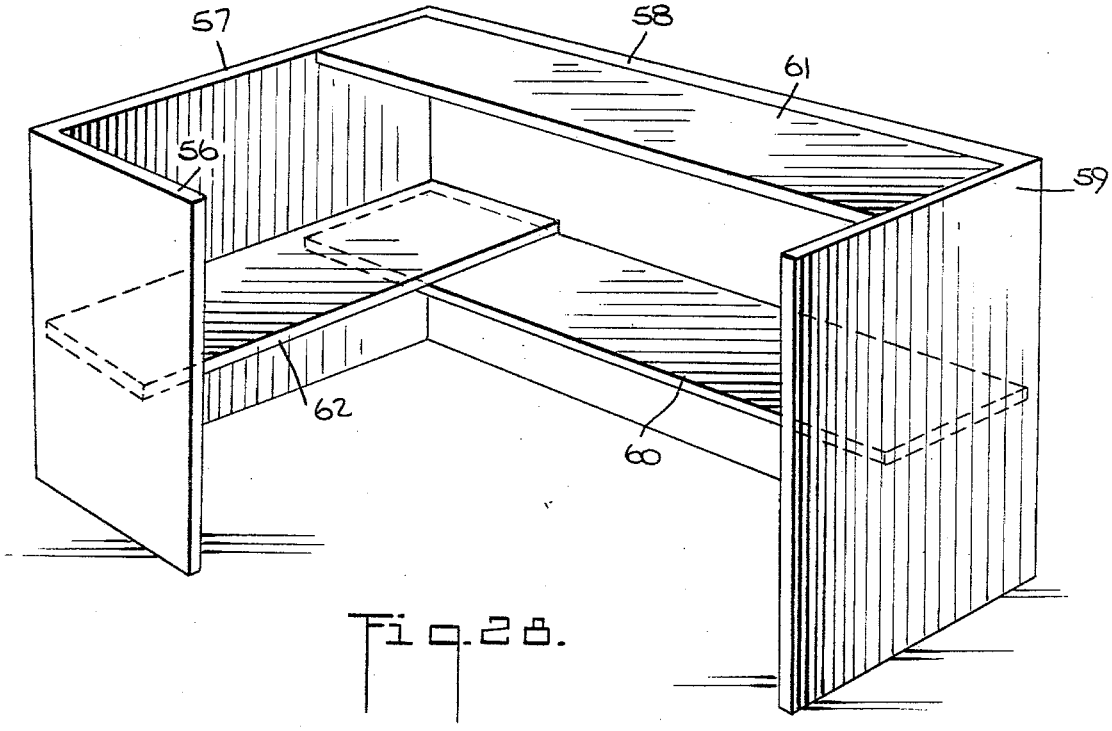
FIG. 28 shows, in perspective, a second embodiment of a work station formed from a furniture system in accordance with the invention and including an L-shaped table surface.

In the work station shown in FIG. 1, the module is composed of three sections, a center section and two wing sections hinged thereto, and the table top component bridges the wing sections. In the second version of a work station shown in FIG. 28, the module for this structure is composed of four interconnected sections 56, 57, 58 and 59, which are fabricated in essentially the same manner as the module in the first work station, the sections being formed by side-by-side core panels to which carpet layers are laminated.

When the module is erected by folding in the sections, section 58 forms a rear wall panel, sections 57 and 59 form side wall panels, section 57 being broader than section 59, while section 56 forms a short front wall panel.

Side sections 57 and 59 are bridged by a table top component 60 whose inner edge rests against rear section 58, the side section also being bridged by an upper shelf component 61. The front and rear sections 58 and 56 are bridged by a second table top component 62 whose inner edge lies against side section 57. Thus the table surface available to a user of this work station has an L-shaped formation to provide an extended work area.

The relative sizes of this section of the module are such that in its collapsed state, sections 59 and 57 are folded over and superposed on section 58, and section 56 is folded over and superposed on section 57 to provide a compact package for storage and shipment.

Desk

Figure 29:
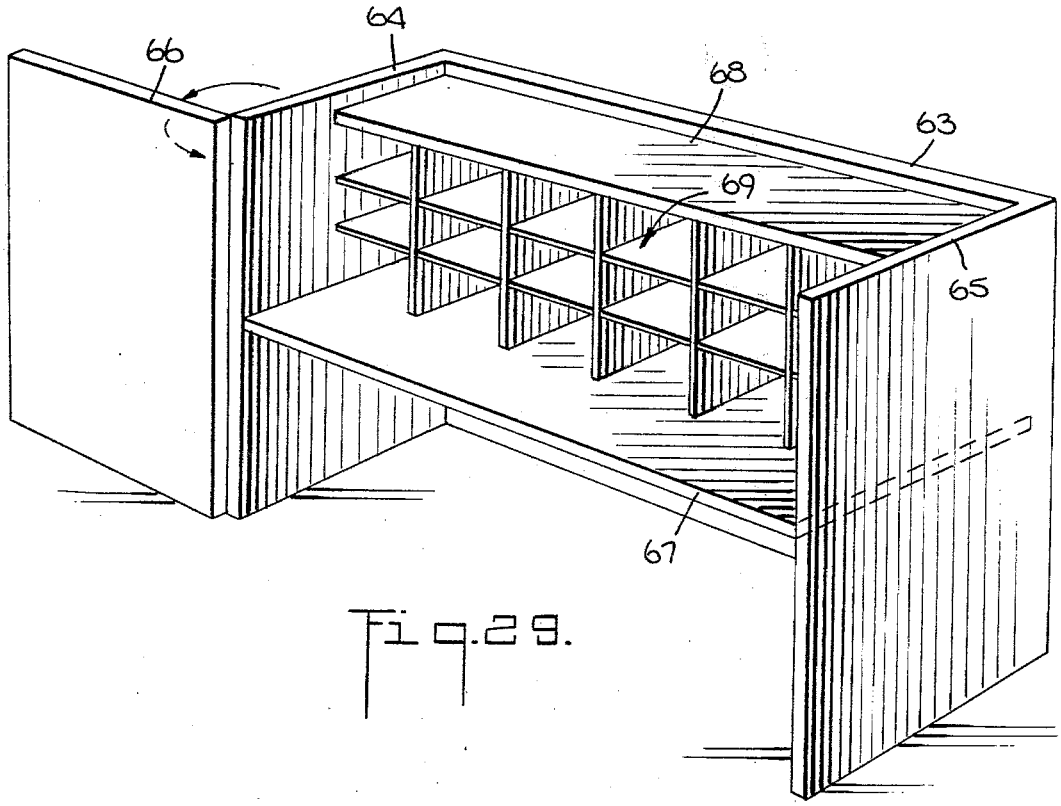
FIG. 29 shows, in perspective, a desk formed from a furniture system in accordance with the invention and provided with a cellular storage space unit.

A desk made from a furniture system in accordance with the invention, as shown in FIG. 29, makes use of a module having a center section 63 and two wing sections 64 and 65 hinged thereto, plus an auxiliary section 66 hingedly connected to wing section 64. This module is similar to the module for the work station shown in FIG. 1, save for the auxiliary section 66 which may be angled with respect to wing section 64 to form a screen. The desk module is composed of core slabs or panels to which carpet layers are laminated, the layers providing the hinges connecting the sections.

The desk includes a first horizontal component 67 bridging wing sections 64 and 65 to form a table surface, and a second horizontal component 68 bridging the same side sections and forming an upper shelf.

Installed between the shelf and top components 68 and 67 is a cellular unit 69 providing cubby holes for storing papers and other materials. The nature of this unit and the manner in which it is fabricated will be described in a subsequent section of this specification. The horizontal components are coupled to the sections of the erected module by fasteners of the type previously described. The desk may be assembled and disassembled in the manner of the work station previously described.

Storage Cabinets

Referring now to FIGS. 30 and 31, there is shown a storage cabinet attachment, generally designated by numeral 70, which takes the form of a small sub-module constituted by a rear section 71, two side sections 72 and 73 and two front door sections 64 and 75. All of these sections are interhinged by laminated carpet layers, the sub-module being made in the same manner as a furniture module.

When, therefore, there is erected an article of furniture formed by a module having right-angle sections 76 and 77, as shown in FIG. 30, and including two horizontal components in the form of parallel shelves 78 and 79, the cabinet attachment 70 may be inserted between these shelves and held frictionally therein.

Because the sub-module is carpet-covered and therefore has a depressible pile, it may be so dimensioned with respect to the space in which it is to be inserted as to require a force fit. When the cabinet attachment is inserted between the shelves, the carpet pile which is formed of flexible fibers is depressed to hold the sub-module in place without the need for fastening expedients. Door sections 74 and 75 are dimensioned so as to overlie the edges of the shelf components and thereby afford a more finished appearance.

Another version of a storage cabinet attachment is shown in FIGS. 32 and 33 where the sub-module 80 in this instance takes the form of a partition section 81 on one edge of which are hinged a pair of door sections 82 and 83, the hinging being effected by the carpet layers laminated to these sections.

Thus when this version of a cabinet attachment is installed by forcing partition section 81 between horizontal shelf components 77 and 79, this then creates two storage spaces to which access is had through door sections 82 and 83. Magnetic or other releasable latching means may be used to hold the doors in their closed positions.

FIG. 34 shows still another cabinet arrangement for an article of furniture whose module includes sections 84 and 85 at right angles to each other. In this instance, the upper shelf component 86 is provided with a drop-down leaf 87 which acts as a lift-up door with respect to a space between shelf component 86 and a second shelf component 89. And, as shown in FIG. 35, the upper shelf component 86 and its leaf 87 have carpet layers laminated thereto which provide the necessary living hinge. Here again, suitable latching means may be provided between the edge of shelf 89 and door 87.

Cellular Storage Attachments

FIG. 29 shows a cellular storage attachment inserted between two parallel shelves on a desk. The manner in which this attachment is fabricated and its structure are illustrated in FIGS. 38 to 40. This attachment includes an array of parallel horizontal slats $SH_1$, $SH_2$, $SH_3$, etc., each provided with a series of equi-spaced slots $l_h$ indented in one edge of the slats. The attachment further includes an array of parallel vertical slats $SV_1$, $SV_2$, $SV_3$ etc., each having a series of equi-spaced lateral slats $l_v$ indented on the opposite edge of these slats.

The horizontal array of slats is intermeshed by way of the slots, with the vertical array of slots in the manner shown in FIGS. 38, 39 and 40, to create an eggcrate-like multi-cellular structure whose final formation is illustrated in FIG. 37. Because all slats are covered by carpet layers, the depressible carpet piles afford the necessary friction to hold the intermeshing slats together and to conceal any defects in the cutting of the slots.

The depth of the cells in the storage attachment which is shown in FIG. 37 is equal to the width of the slats. In order to double the storage capacity of the unit, the horizontal slats thereof, as shown by horizontal slat $SH_4$ in FIG. 41, may be of double width. The horizontal slats are provided with slots $l_h$ indented in both edges to intermesh at each slot axis with a pair of vertical slats $SV_4$ and $SV_5$ which lie in the same plane.

Room Dividers

FIGS. 43, 44 and 45 show room dividers or screens which are carpet covered and therefore may be coordinated with carpet-covered furniture made in accordance with the invention.

To this end, as shown in FIG. 2, use is made of a pair of corrugated flexible fiberglass panels 90 and 91 in side-by-side relationship which are laid down and adhesively bonded to a carpet sheet 92, so that the sheet conforms to the corrugations. Then when one corrugated panel is folded over the other, the zone Z of the carpet sheet which hinges the two panels together then forms the carpeted edge of the resultant screen.

Also provided are flat end strips 93 and 94 which are sandwiched between the carpet coverings when the corrugated panels 90 and 91 are folded over and intermeshed, as shown in FIG. 45. In this state, the folded carpet sheet then has a front face 92A and a back face 92B. The flat end strips 93 and 94 which are carpet-hinged to the corrugated panels make it possible to flex the screen, as shown in FIG. 44. In practice, a curved screen may be set up between two adjacent pieces of furniture, the end strips serving as touch plates to effectively join the pieces.

Duct Work

Figure 46:
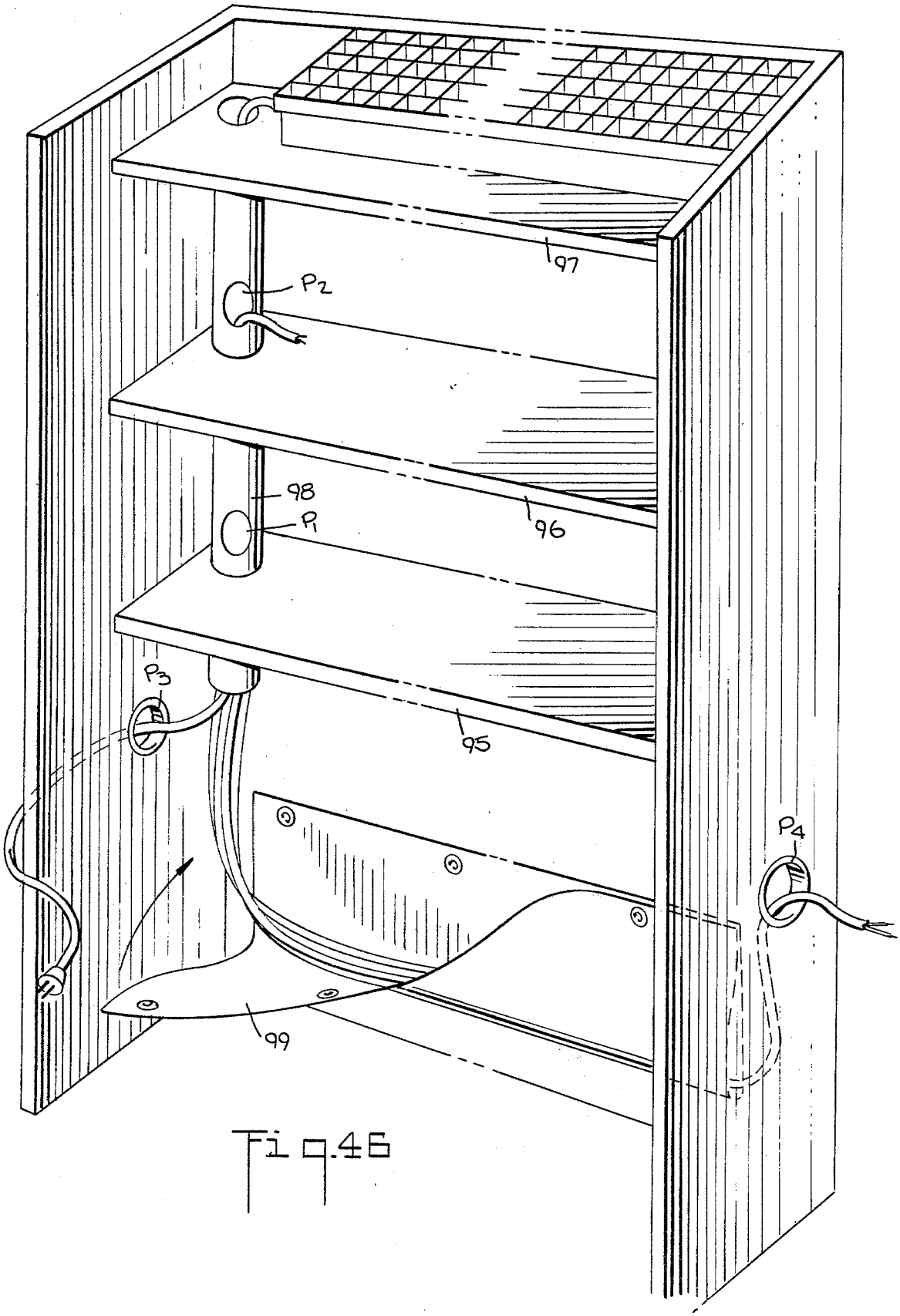
FIG. 46 shows a multi-tier storage case formed from a furniture system in accordance with the invention and the manner in which electrical wires are brought from external points to the various tiers.

Referring now to FIG. 46, there is shown a multi-tier storage unit made from a three section module in combination with horizontal shelf components or tiers, 95, 96 and 97. To provide a conduit for electrical power, telephone and other wires, a vertical tube 98 is extended through aligned openings in the tiers and is provided with outlet ports $P_1$ and $P_2$, making it possible to lead wires from the tube into the tiers for connection to electrical devices such as a telephone set. The wires from the lower end of the tube may be led out of the module through a near port $P_3$ in one side section and through a far port $P_4$ in the opposite side section. In the latter case, the wires extending from the lower end of tube 98 to far port $P_4$ may be concealed by a snap-button canvas covering 99.

As shown in FIGS. 48 and 49, vertical and horizontal ducts $D_1$ and $D_2$ in a T-formation may be embedded within a section of the module to carry wires to various points. These ducts, which have a rectangular cross section are provided with a snap-on cover $C_o$ that has a carpet layer laminated thereto so that when the duct is closed its presence is not perceptible.

Instead of embedding ducts in the module sections, these may be secured to edges thereof, as shown by ducts $D_3$ and $D_4$ in FIG. 47.

Modifications

In the core panels illustrated in FIGS. 6 and 7, the panels are provided with longitudinally-extending slots along their edges to provide a cutting guide for trimming off the excess margin of the upper and lower fabric layers, so that they are cut to abut at the slots. Alternatively, as shown in FIG. 50, a cutting guide slot $CG_1$ may be indented in the upper face adjacent the edge of the core panel whereby the underside fabric layer then has its margin carried over the edge and folded down on the upper face to overlap the slot, the excess being trimmed. The upperside fabric layer in this instance is brought over the slot and its excess trimmed; hence the abutting ends of the fabric layers are not along the edges of the panel but adjacent the panel edges.

Another approach, as shown in FIG. 51, which has practical advantages is to indent a cutting guide slot $CG_2$ at the upper corner of the panel edge, so that the trimmed fabric layers then have their ends abutting at this slot position.

When adjacent core panel edges of the module are mitered, in the manner shown in FIGS. 14, 15 and 16, the cut angles are such as to permit folding-in to create a right angle corner and folding-over to superpose one section of the module over the other. It may be desirable, in some instances, to so miter the adjacent edges $E_1$ and $E_2$, as shown in FIG. 52, so that they have an equilateral triangular formation. This makes it possible to fold-in the module sections to create a right angle corner or to fold-out the sections to create a right angle corner in the opposite direction.

Advantages

In modular or knock-down furniture of the type heretofore known, the assembly of interfitting components must be bolted or otherwise fastened together; and unless the components are tailored to precise dimensions, cracks or gaps will develop between these components where they do not exactly fit together. These gaps impart a makeshift appearance to the resultant structure and render the assembled piece commercially unappealing. In order, therefore, to avoid such effects, a maker of knock-down furniture must manufacture to very tight tolerances, a requirement which contributes substantially to the cost of production and the ultimate selling price to the purchaser.

In contradistinction, the present invention makes it possible to produce the components of the assembly on a massproduction low-cost basis, using rough tolerances and yet provide a furniture article having a finished and attractive appearance. The reason for this can best be described as the "fuzz-factor." The textile layers are formed of pile fabric, needle-punched carpet material or any other natural or synthetic woven or non-woven fabric having a compressible fuzzy surface or pile. Hence the interfaces of assembled components are defined by fabric piles which are pressed together and serve to close whatever gap exists at the junction. As a result, small dimensional imperfections in the components which otherwise would be visible are hidden by the fabric.

This concealment also applies to the cleat-type fasteners which connect the components; for though the cleats project from the edges and create gaps, these gaps are filled by the fabric piles. Thus the fabric layers on the multi-section module and on the horizontal components in a system according to the invention, afford a clean, professional finish which hides all underlying defects or inaccuracies in the structure.

The fuzz-factor also comes into play in locating and aligning furniture pieces made in accordance with the invention. When conventional pieces are located side-by-side in a facility, the pieces must be carefully levelled, otherwise an ungainly gap will develop between the pieces. But with the present invention, the fabric piles at the junctions of the pieces act to close any gap resulting from a lack of level or alignment.

While there have been shown and described preferred embodiments of furniture systems in accordance with the invention, it will be appreciated that many changes and modifications may be made therein without, however, departing from the essential spirit thereof.

I claim:

1. A furniture system comprising:

A. a multi-section module constituted by a plurality of core panels in side-by-side relation, the adjacent edges of the side-by-side core panels being mitered at an angle whereby when the sections, when folded in, are at right angles to each other, and facing layers formed of textile material laminated to the inner and outer faces of said panels to define interconnecting hinges therefor, formed by both facings, whereby the section of the module may be folded over to provide a flat state structure for storage and shipment, said module being erected by folding in sections thereof to define a structure having at least a vertical rear wall and two vertical side walls hinged to the ends of the rear wall to form an alcove, said facing layers having a compressible fuzzy surface to close any gaps in the hinged junctions between said walls; and B. at least one removable horizontal component receivable within the alcove to bridge the side walls and connected thereto by fastening elements.

2. A system as set forth in claim 1, wherein said textile material is a pile fabric.

3. A system as set forth in claim 1, wherein said textile material is a needle-punched, non-woven synthetic carpet material.

4. A system as set forth in claim 1, wherein said core panels are formed of solid wood.

5. A system as set forth in claim 1, wherein said core panels have a framed-wood structure.

6. A system as set forth in claim 1, wherein said core panels have a composite wood and foam plastic structure.

7. A system as set forth in claim 1, wherein said core panels are in a frame structure filled with an acoustic batting.

8. A system as set forth in claim 1, wherein said system module has three sections and including two horizontal components which bridge the side walls at different levels in the alcove, one acting as a table surface and the other as a shelf to provide a work station.

9. A system as set forth in claim 1, wherein said facing layers have dimensions exceeding the area occupied by side-by-side core panels to provide margins extending beyond said area, which margins are folded over and laminated to the edges of the core panels.

10. A system as set forth in claim 9, wherein said core panels are provided with longitudinally-extending slots along their edges, making it possible to cut off excess margin material by running a knife through the slots.

11. A system as set forth in claim 1, wherein said fastening elements each consist of a cleat attached to an edge of the horizontal component by a single screw whereby the cleat is turnable, said cleat having a slot adapted to receive the head of a stud anchored in the associated side wall of the module when the slot entry is aligned therewith, the stud being thereafter locked by turning the cleat.

12. A system as set forth in claim 11, wherein said cleat is formed by a strip of metal bent to define a front portion containing said slot and a rear portion having a bore therein to receive said screw.

13. A system as set forth in claim 12, wherein said cleat has a generally square configuration whereby it may be turned by a wrench.

14. A system as set forth in claim 1, wherein said module has four sections which when erected define a rear wall, two side walls hinged to the ends of the rear wall at right angles thereto and a front wall hinged at right angles to one of the side walls, a first horizontal component bridging the side walls, and a second horizontal component bridging the front wall and the rear wall to form an L-shaped table surface.

15. A system as set forth in claim 1, said system including a first horizontal component which bridges the side walls to form a table surface, a second horizontal component which bridges the side walls to form a shelf thereabove, and a cellular unit insertable between the two horizontal components, said unit being formed of intermeshing vertical and horizontal slats each constituted by a core having facing layers of needle-punched carpet material laminated thereto.

16. A system as set forth in claim 1, wherein textile material also covers said horizontal component, the textile material on the module and on the component having a compressible surface fuzz.

17. A system as set forth in claim 1, said system including two horizontal components which bridge the side walls to form parallel shelves, and a cabinet attachment insertable in the space between the parallel shelves and constituted by a sub-module formed by interhinged front, side and front door sections.

18. A flexible screen extendible between two articles of furniture each formed by a system as set forth in claim 1, said screen being constituted by a pair of corrugated flexible fiberglass panels in side-by-side relation laminated to a single sheet of needle-punched synthetic carpet material, the corrugated panels being thereaffter superposed over each other whereby the carpet junction therebetween then forms the upper edge of the screen.

* * * * *